US010495373B2

(12) United States Patent
Jung et al.

(10) Patent No.: US 10,495,373 B2
(45) Date of Patent: Dec. 3, 2019

(54) REFRIGERATOR

(71) Applicant: LG ELECTRONICS INC., Seoul (KR)

(72) Inventors: Yongki Jung, Seoul (KR); Chanju Pae, Seoul (KR)

(73) Assignee: LG Electronics Inc., Seoul (KR)

( * ) Notice: Subject to any disclaimer, the term of this patent is extended or adjusted under 35 U.S.C. 154(b) by 159 days.

(21) Appl. No.: 15/397,860

(22) Filed: Jan. 4, 2017

(65) Prior Publication Data

US 2017/0191739 A1 Jul. 6, 2017

(30) Foreign Application Priority Data

Jan. 5, 2016 (KR) ..... 10-2016-0001257
Mar. 23, 2016 (KR) ..... 10-2016-0034969

(51) Int. Cl.
*F25D 23/04* (2006.01)
*A47B 96/06* (2006.01)
(Continued)

(52) U.S. Cl.
CPC ..... *F25D 23/04* (2013.01); *A47B 96/06* (2013.01); *F25D 11/00* (2013.01); *F25D 25/022* (2013.01); *F25D 29/005* (2013.01); *F25D 23/025* (2013.01)

(58) Field of Classification Search
CPC ..... A47B 88/95; A47B 2088/951; A47B 2210/175; A47B 57/10; A47B 57/32;
(Continued)

(56) References Cited

U.S. PATENT DOCUMENTS 3,709,576 A * 1/1973 Lemoine ..... F25D 23/04 211/90.03
4,859,010 A * 8/1989 Jeziorowski ..... A47B 57/10 312/321.5
(Continued)

FOREIGN PATENT DOCUMENTS

DE 102012008596 * 10/2013
EP 2220446 8/2010
(Continued)

OTHER PUBLICATIONS

Extended European Search Report in European Application No. 17150382.4, dated May 12, 2017, 9 pages (with English translation).

*Primary Examiner* — Janet M Wilkens
(74) *Attorney, Agent, or Firm* — Fish & Richardson P.C.

(57) ABSTRACT

A refrigerator includes a cabinet that defines a storage space. The refrigerator further includes a door that is mounted to the cabinet and that is configured to open and close the storage space. The refrigerator further includes a mounting part that is located on an inner surface of the door. The refrigerator further includes baskets that are each detachably mounted to the mounting part. Each basket includes a basket body that defines an accommodation space that is configured to receive food and that includes a recessed part on a bottom surface of the basket body. Each basket includes a frame that is located in the recessed part, that is configured to support the basket body, and that is detachably mounted to the mounting part.

15 Claims, 20 Drawing Sheets

(51) Int. Cl.

| | |
|---|---|
| ***F25D 11/00*** | (2006.01) |
| ***F25D 25/02*** | (2006.01) |
| ***F25D 29/00*** | (2006.01) |
| *F25D 23/02* | (2006.01) |

(58) Field of Classification Search
CPC ..... F25D 25/025; F25D 23/028; F25D 23/04; F25D 23/025; F25D 23/022; F25D 23/067; F25D 11/02; F25D 29/005
USPC ..... 312/404, 405.1, 321.5, 402, 408, 330.1
See application file for complete search history.

(56) References Cited

U.S. PATENT DOCUMENTS

| | | | | |
|---|---|---|---|---|
| 4,921,315 | A * | 5/1990 | Metcalfe | A47B 96/16 312/321.5 |
| 5,004,305 | A * | 4/1991 | Montuoro | F25D 23/04 312/350 |
| 5,346,299 | A * | 9/1994 | Werkmeister | F25D 23/04 312/405.1 |
| 5,375,924 | A * | 12/1994 | Pohl | A47B 57/10 108/109 |
| 5,951,134 | A | 9/1999 | Braun et al. | |
| 6,908,163 | B1 * | 6/2005 | Hebeler | F25D 23/04 312/321.5 |
| 9,816,746 | B1 * | 11/2017 | Haney | F25D 11/00 |
| 2006/0082270 | A1 | 4/2006 | Collins et al. | |
| 2012/0018435 | A1 * | 1/2012 | Kim | F25D 23/04 220/592.02 |
| 2014/0139091 | A1 * | 5/2014 | Oh | F25D 23/02 312/404 |
| 2014/0239790 | A1 * | 8/2014 | Yoo | F25D 25/025 312/404 |
| 2014/0265800 | A1 * | 9/2014 | Haltmeyer | F25D 25/025 312/404 |
| 2017/0191739 | A1 * | 7/2017 | Jung | A47B 96/06 |
| 2017/0191741 | A1 * | 7/2017 | Jung | F25D 23/04 |
| 2017/0350642 | A1 * | 12/2017 | Yang | F25D 25/025 |

FOREIGN PATENT DOCUMENTS

| | | | |
|---|---|---|---|
| EP | 2594874 | | 5/2013 |
| EP | 2770285 | | 8/2014 |
| KR | 20-1999-0035666 | | 9/1999 |
| KR | 10-2010-0046360 | | 5/2010 |
| KR | 1020100046360 | * | 5/2010 |
| KR | 10-2012-0006723 | | 1/2012 |
| KR | 10-2012-0015988 | | 2/2013 |
| KR | 10-2013-0053593 | | 5/2013 |
| KR | 10-2013-0058084 | | 6/2013 |
| WO | 2016060456 | * | 10/2015 |
| WO | 2016129944 | * | 8/2016 |

* cited by examiner

REFRIGERATOR

CROSS-REFERENCE TO RELATED APPLICATIONS

This application claims priority under 35 U.S.C. 119 and 35 U.S.C. 365 to Korean Patent Applications No. 10-2016-0001257 filed on Jan. 5, 2016 and No. 10-2016-0034969 filed on Mar. 23, 2016 in Korea, the entire contents of both are hereby incorporated by reference in their entirety.

BACKGROUND

In general, a refrigerator, which is a home appliance that may store foods in a storage space therein shielded by a door at a low temperature, is configured to store stored foods in an optimum state by cooling an inside of a storage space using cold air generated through heat exchange with a refrigerant circulating in a refrigerating cycle.

SUMMARY

Refrigerators tend to be enlarged and multi-functioned due to a change in dietary habits and diversification of tastes of a user, and refrigerators having various structures and convenience equipment mounted thereon for user's convenience and freshness of stored foods have been released.

In particular, with an increase in an accommodation capacity of the refrigerator, a capacitor of a door basket that defines an accommodation space on a rear surface of the door of the refrigerator is increased. Accordingly, a refrigerator for providing a stable fixing structure has been developed.

Further, a refrigerator has been developed in which the door basket is made transparent so that an outer appearance thereof may be further improved, and at the same time, inner foods may be easily identified.

The conventional refrigerator having such a structure has a problem in that when a door basket is transparently formed to identify foods accommodated in the door basket, a mounting part on an inner surface of a door, to which the door basket is coupled, is exposed through the door basket, and thus an outer appearance thereof is not good.

Further, there is a problem in that when a capacity of the door basket is large, mounting stability of the door basket deteriorates, and thus, when a door is opened, the door basket is arbitrarily detached.

According to an innovative aspect of the subject matter described in this specification, a refrigerator includes a cabinet that defines a storage space; a door that is mounted to the cabinet and that is configured to open and close the storage space; a mounting part that is located on an inner surface of the door; and baskets that are each detachably mounted to the mounting part and that each include a basket body that defines an accommodation space that is configured to receive food and that includes a recessed part on a bottom surface of the basket body; and a frame that is located in the recessed part, that is configured to support the basket body, and that is detachably mounted to the mounting part.

This and other implementations may include one or more of the following optional features. Each frame includes a frame body that has a rectangular ring shape and that is located in the recessed part; and frame mounting parts that are located on each side of the frame body and that are mounted to the mounting part. Each basket body includes a transparent material such that the accommodation space is visible from outside the basket. Each frame comprises an opaque material such that the corresponding mounting part is not visible. The mounting part includes side surfaces that are each located on a corresponding inner surface of a door dike that protrudes from edges of the door; and a rear surface that is configured to connect the side surfaces.

Each basket includes a support rib that protrudes from a rear surface of the basket and that is configured to engage the rear surface of the mounting part. The mounting part is part of mounting parts that are located in door dikes that protrude from left and right edges of the door. The mounting parts extend in a direction parallel to a bottom surface of a corresponding basket. A side surface of the frame is configured to cover the mounting part by extending downward from a location corresponding to a location of the mounting part. The mounting part includes inclined surfaces that increase in thickness towards the rear surface of the mounting part and that are located at front ends of the mounting part.

Each inclined surface defines fixing grooves that are recessed in the inclined surface and that are located between the inclined surface and the rear surface of the mounting part. Each frame defines guide grooves that are configured to receive the mounting part. Each frame includes a resilient part that defines a lower surface of each guide groove and that is configured to deform vertically based on engaging the mounting part. Each frame includes a fixing protrusion that extends downward and that defines an interval between the fixing protrusion and the resilient part that is smaller than a thickness of the mounting part. The fixing protrusion is in a location that corresponds to a corresponding fixing groove based on the basket being mounted to the mounting part.

The door includes a main door that is configured to open and close the cabinet by rotating and that defines an opening to the storage space, a sub-door that is rotatably mounted to the main door and that is configured to open and close the opening to the storage space. The mounting part defines an inner surface of the opening to the storage space. Each basket is mounted to the mounting part and is spaced apart from a rear surface of the sub-door. The mounting part includes first mounting parts that protrude toward the opening, that comprise metal, and that are located on an inside of the mounting part. Each frame is a fixing frame that comprises metal and that includes fixing mounting parts that are at locations that correspond to the first mounting parts and that are configured to receive the first mounting parts.

Each first mounting part comprises an extension that protrudes from a side surface of the mounting part towards the opening and a bent part that is bent upward and that is at an end of the extension. Each fixing mounting part is recessed in a lower surface of the fixing frame towards a top of the corresponding basket and is configured to receive a corresponding first mounting part. The refrigerator further includes fixing members that are each rotatably mounted, at an end of a corresponding fixing member, to the lower surface of the fixing frame. Each fixing member is configured to restrain the corresponding first mounting part by rotating based on the corresponding first mounting part being inserted into the corresponding fixing mounting part. The mounting part includes third mounting parts that comprise plastic and that protrude from lower ends of the mounting part.

The frame is a seating frame that comprises plastic and that includes seating mounting parts that are recessed in a lower surface of the frame and that are each configured to receive a corresponding third mounting part. Each seating mounting part includes a seating frame protrusion that protrudes downward and that is located inside the seating mounting part. Each third mounting part includes a protrusion inserting part that is configured to receive a corresponding seating mounting part. Each seating frame protrusion and each protrusion are angled towards a lower front portion of the refrigerator.

The basket body includes a catching part that protrudes forward and that is located at a front lower end of the basket body. A lower surface of the mounting part includes a protrusion step that defines a catching supporting part that protrudes upward and that is configured to receive the catching protrusion. The opening includes a display unit that is configured to display and control an operation state of the refrigerator. The display unit is mounted on the protrusion step. An inner surface of the mounting part includes second mounting parts that are recessed inward towards a center of the door. The frame is a movable frame that is configured to connect to the second mounting parts and that is vertically adjustable with respect to the second mounting parts.

DETAILED DESCRIPTION

In the description, terms such as first, second, A, B, (a), (b) or the like may be used herein when describing components. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
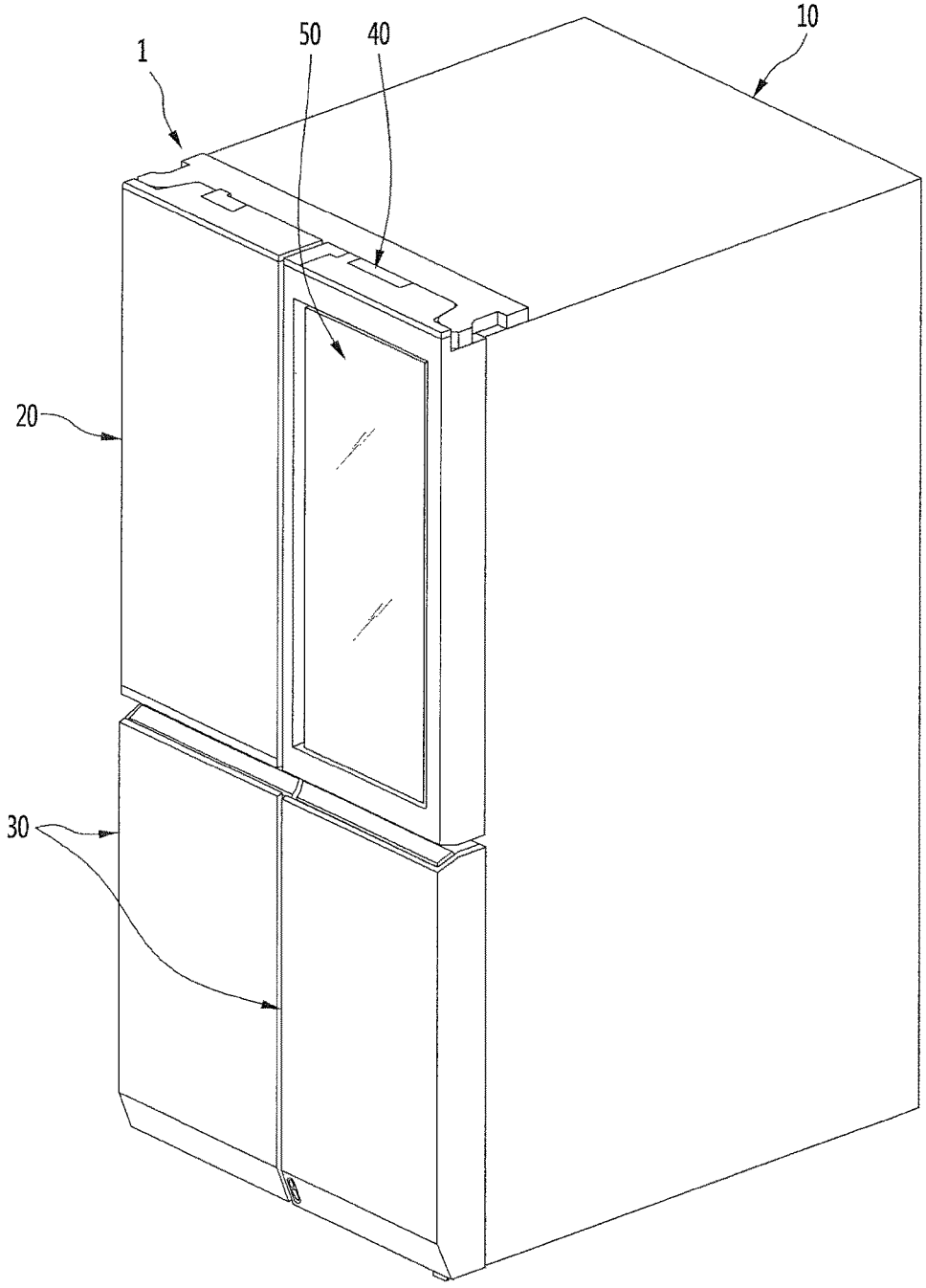
FIG. 1 is a perspective view of an example refrigerator.
Figure 2:
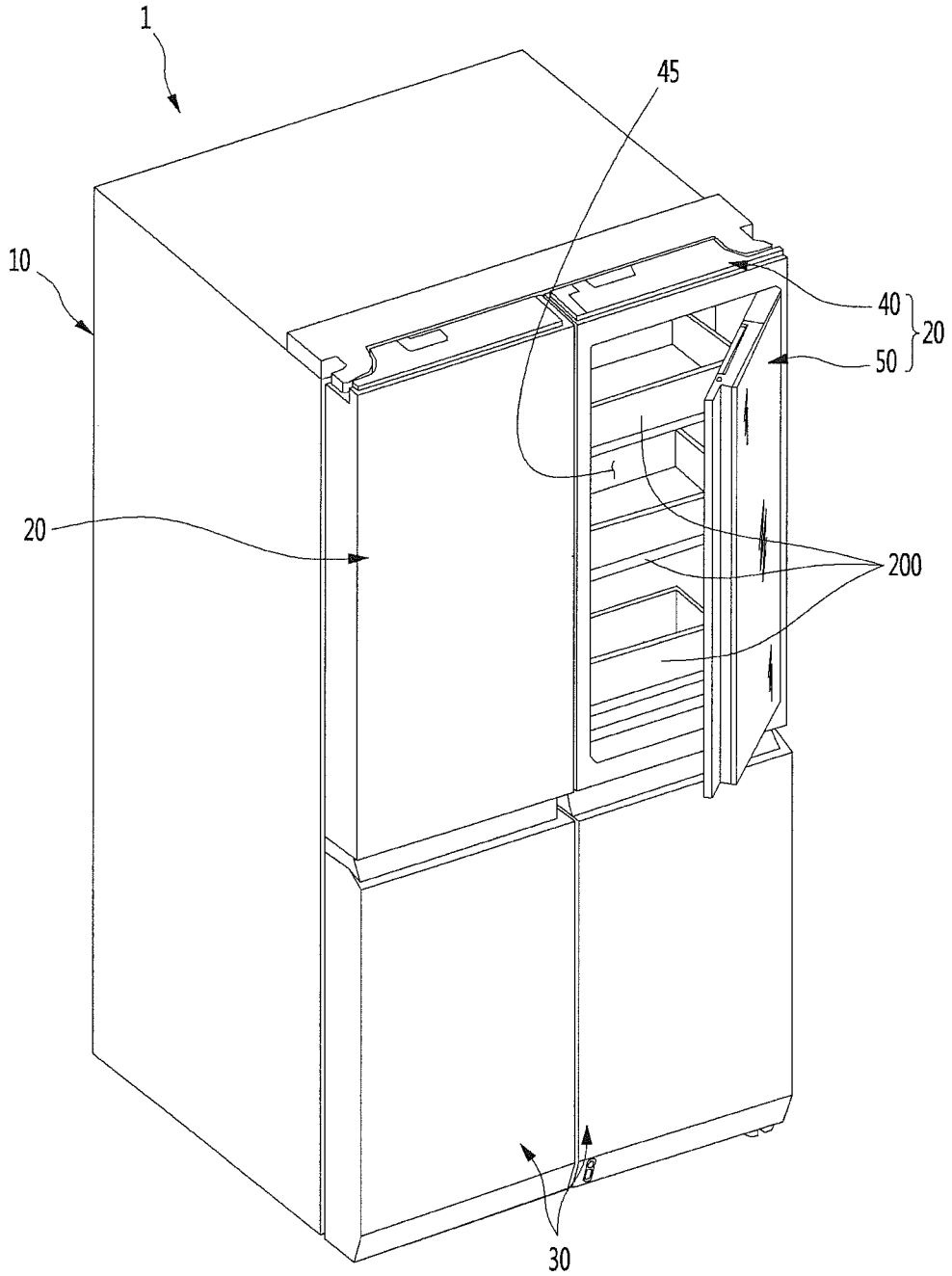
FIG. 2 is a perspective view of an example refrigerator with a sub-door opened.
Figure 3:
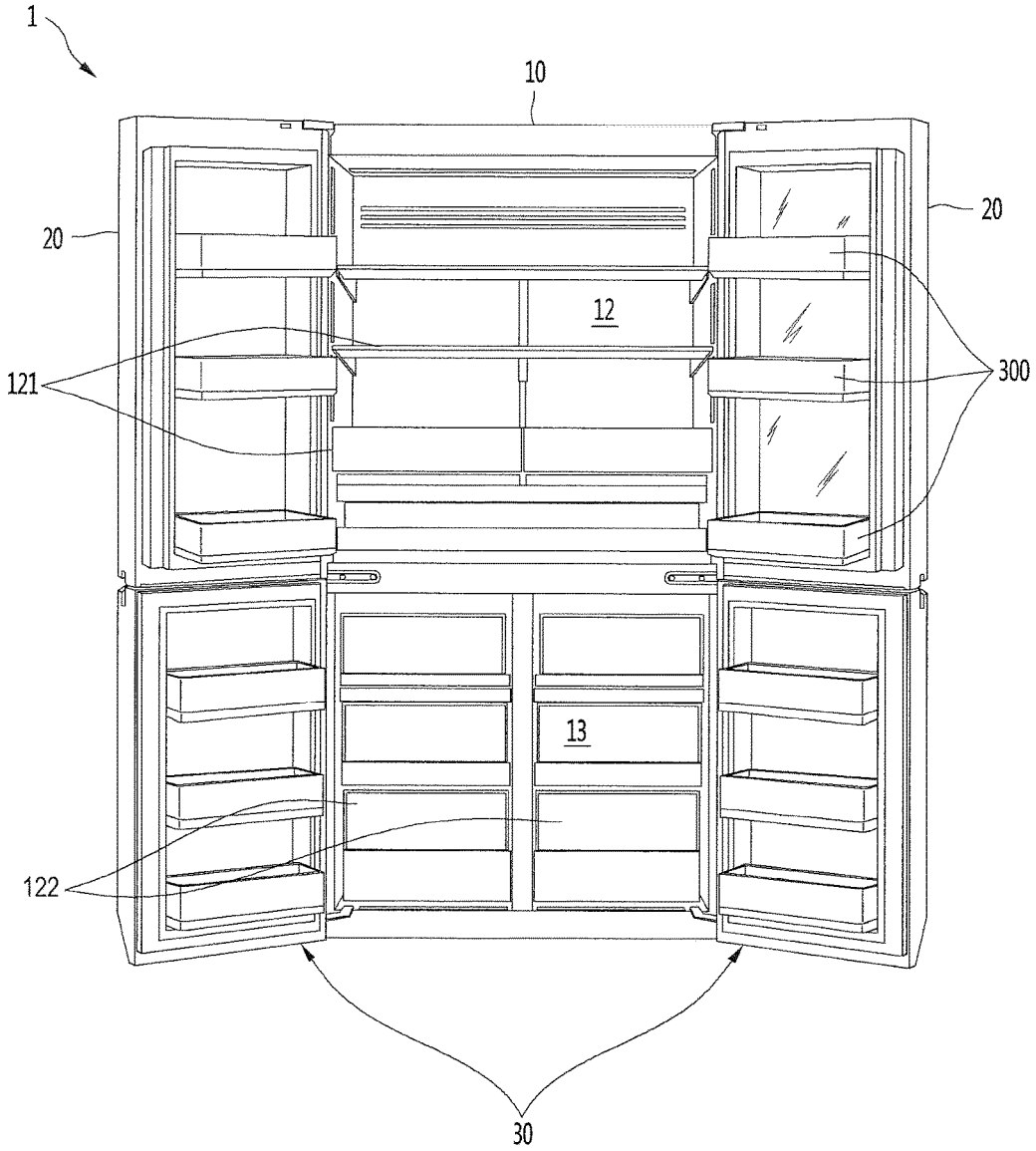
FIG. 3 is a front view of an example refrigerator with the doors opened.

FIG. 1 illustrates an example refrigerator. Further, FIG. 2 illustrates an example refrigerator with an open sub-door. Further, FIG. 3 illustrates an example refrigerator with the doors opened.

As illustrated in the drawings, an outer appearance of a refrigerator 1 may be defined by a cabinet 10 that defines a storage space and doors that opens/close the storage space.

An interior of the cabinet 10 may be vertically partitioned by a barrier 11, a refrigerating chamber 12 may be formed above the cabinet 10, and a freezing chamber 13 may be formed below the cabinet 10.

In some implementations, various accommodation members 121 such as a shelf, a drawer and a basket may be provided inside the refrigerating chamber 12. The accommodation members 121 may be inserted or withdrawn in a state in which the doors are opened, as needed, and may accommodate and store foods through the insertion and withdrawal.

Insertable and withdrawable drawer-shaped freezing chamber accommodating members 122 may be mainly arranged inside the freezing chamber, and these freezing chamber accommodating members 122 may be configured to be inserted and withdrawn in conjunction with opening of freezing chamber doors 30.

The doors may include refrigerating chamber doors 20 and freezing chamber doors 30. The refrigerating chamber doors 20 may be configured to be opened/closed through pivoting a front opened surface of the refrigerating chamber 12, and the freezing chamber doors 30 may be configured to be opened/closed by pivoting a front opened surface of the freezing chamber 13. In some implementations, the pair of refrigerating chamber doors 20 and the pair of freezing chamber doors 30 may be formed on left and right sides of the refrigerator 1 and may be configured to shield the refrigerating chamber 12 and the freezing chamber 13, respectively.

A plurality of baskets 200 may be formed in the refrigerating chamber doors 20 and the freezing chamber doors 30, and the baskets may be configured so as not to interfere in accommodation members that are provided inside the refrigerator in a state in which the refrigerating chamber doors 20 and the freezing chamber doors 30 are closed.

Although an example where a french-type door that includes a pair of doors and opens/closes one space by rotating the doors is applied to a bottom freeze-type refrigerator in which a freezing chamber is provided below is illustratively described, the present disclosure may be applied to all types of refrigerators having doors regardless of types of the refrigerators.

The refrigerating chamber doors 20 and the freezing chamber doors 30 define the entire outer appearance when viewed from front and the outer appearance is formed of metal, so that the entire refrigerator 1 may have a texture of metal. In some implementations, a dispenser for taking out water or ice may be provided in the refrigerating chamber doors 20, as needed.

A right door (when viewed in FIG. 1) of the pair of the refrigerating chamber doors 20 may be dually opened/closed. In detail, the right refrigerating chamber door 20 may be formed of metal and may include a main door 40 that opens/closes the refrigerating chamber 12 and a sub-door 50 that is rotatably arranged inside the main door 40 to open/close an opening of the main door 40.

The main door 40 may have the same size as that of the left refrigerating chamber door 20 (when viewed in FIG. 1)

of the pair of refrigerating chamber doors 20 and may be rotatably mounted on the cabinet 10 by a hinge to open/close a portion of the refrigerating chamber 12.

In some implementations, an opening 45 that is opened to have a predetermined size is formed in the main door 40. The opening 45 may be formed such that in a state in which the main door 40 is closed, the storage space of the cabinet 10 is exposed to the outside. In some implementations, a plurality of baskets 200 may be mounted inside the opening 45. Thus, a user may approach the baskets 200 on a rear surface of the main door 40 by opening the main door 40. In addition, the user may approach the baskets 200 through the opening 45 even without opening the main door 45.

The plurality of baskets 200 may be vertically provided inside the opening 45, thereby improving user's convenience. In some implementations, the baskets 200 may be provided to have transparency so that the user may easily recognize foods that are accommodated in the baskets 200.

In some implementations, the opening 45 may be formed to occupy most of the front surface of the main door 40 except for a portion of a circumference of the main door 40.

The sub-door 50 may be rotatably mounted inside the opening 45 to open/close the opening 45. In some implementations, at least a portion of the sub-door 50 may be formed of a transparent material such as glass. Thus, the user may approach the opening 45 through opening of the sub-door 50, and at the same time, may see through an interior of the opening 45 even in a state in which the sub-door 50 is closed. Thus, the sub-door 50 may be called a see-through door.

Figure 4:
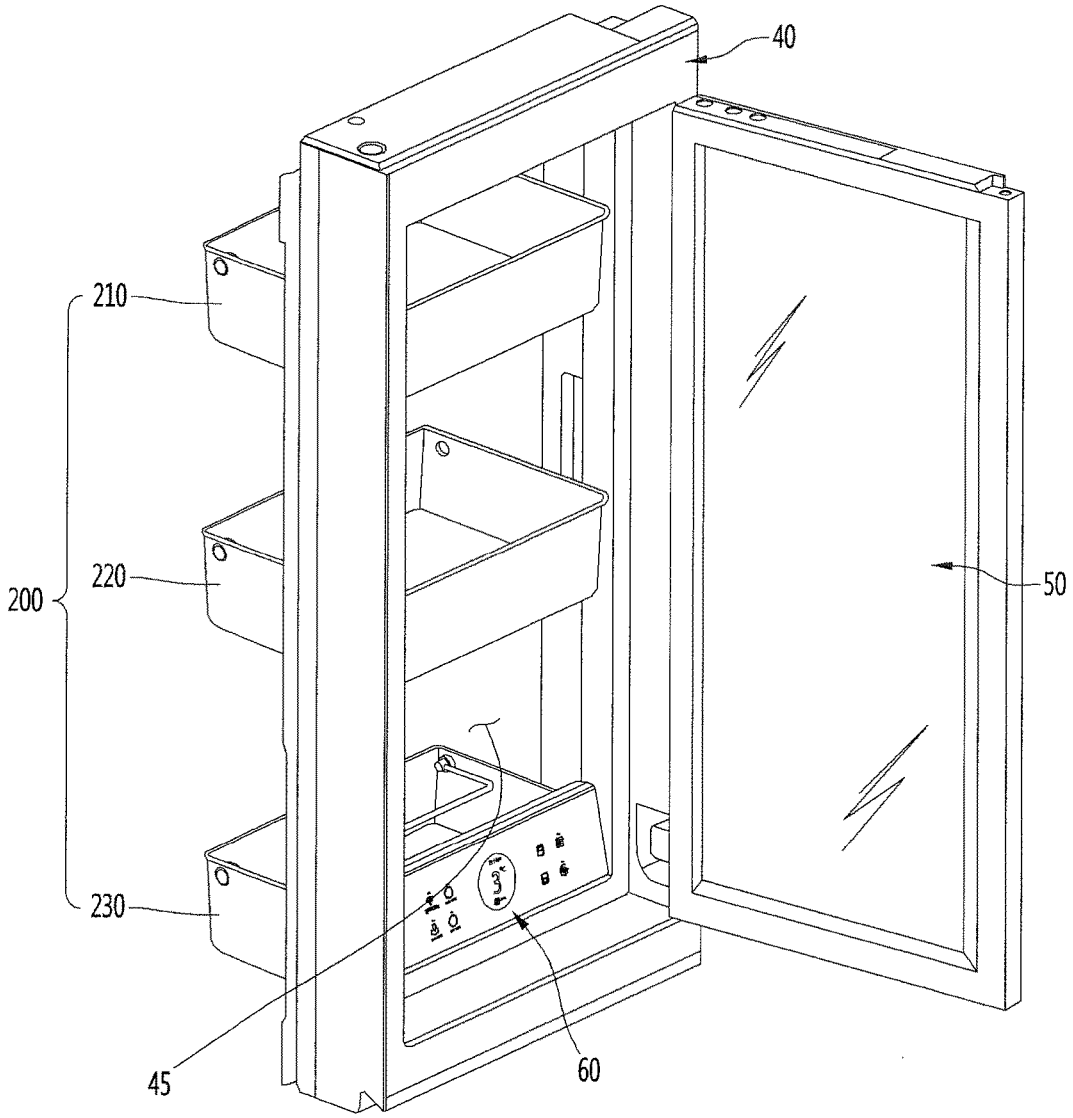
FIG. 4 is a perspective view of an example door with a sub-door opened.
Figure 5:
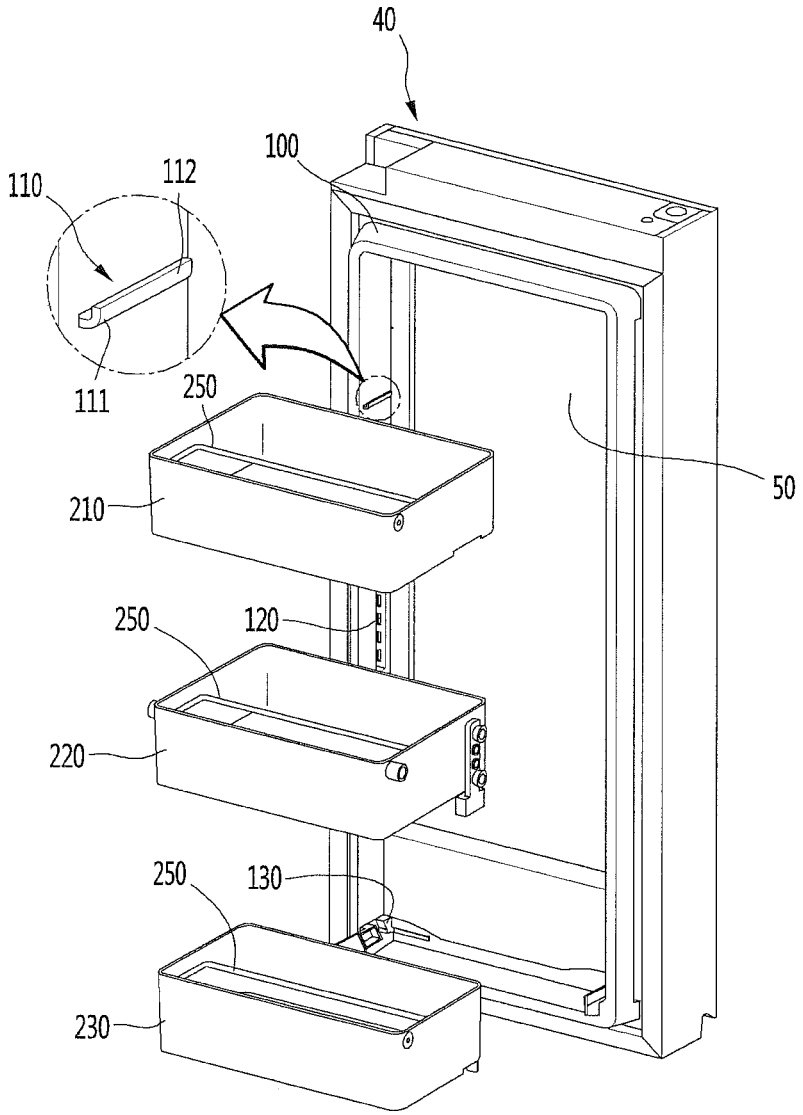
FIG. 5 is a perspective view of an example coupling structure of a door and a basket.

FIG. 4 illustrates an example door with an open sub-door. Further, FIG. 5 illustrates an example coupling structure of a door and baskets.

A display unit 60 may be provided in the opening of the main door 40. The display unit 60 may be provided at a lower end of the opening 45. The display unit 60 may serve to display and manipulate an operation state of the refrigerator 1 and may be configured such that the user may identify the foods through the sub-door 50 from the outside when the sub-door 50 becomes transparent.

The plurality of baskets 200 may be provided inside the opening 45 to be vertically spaced apart from each other. In some implementations, the plurality of baskets 200 may be mounted on the opening 45 in different mounting structures. In some implementations, structures and mounting structures of the plurality of baskets 200 may be identically provided or only one basket 200 may be provided.

Hereinafter, mounting structures of the baskets 200 and detailed structures of the baskets 200 according thereto will be described in detail based on an implementation in which three baskets 200 are provided and the baskets 200 are provided to have different mounting structures.

The baskets 200 may be provided in the opening 45 and may be spaced apart from a rear surface of the sub-door 50.

In some implementations, the baskets 200 may include a first basket 210 that is provided at an upper portion of the opening 45, a third basket 230 that is provided at a lower portion of the opening 45, and a second basket 220 that is provided between the first basket 210 and the third basket 230.

Each basket 200 may have an approximately rectangular box shape and have an accommodation space that is upwardly opened. For example, the basket 200 may include a rectangular plate-shaped lower surface on which foods may be seated and an edge that extends upward from an end of a circumference of the lower surface. In some implementations, the basket 200 may be transparently or semi-transparently provided for a design and convenience of use.

A partition member 250 may be provided in the basket 200. The partition member 250 may be provided to selectively partition the accommodation space of the basket 200 so that the user may more efficiently use the accommodation space of the basket 200.

The partition member 250 may be formed by bending a rod member several times. In some implementations, the partition member 250 may be rotatably provided on a front side or a rear side of an upper end of the accommodation space of the basket 200.

In detail, the partition member 250 may extend towards opposite surfaces of the accommodation space of the basket 200 such that opposite ends thereof are vertically bent. In some implementations, the opposite ends of the partition member 250 may be rotatably mounted on opposite surfaces of the basket 200. Thus, the user may selectively partition the accommodation space of the basket 200 into front and rear parts by rotating the partition member 250.

A mounting part 100 for mounting the basket 200 may be formed in the main door 40. The mounting part 100 may be defined as a part that defines a circumferential surface of the opening 45. For example, the mounting part 100 may include an upper surface, a lower surface and opposite side surface of the opening 45.

The mounting part 100 may define the circumferential surface of the opening 45 and further protrude rearward from the rear surface of the main door 40. For example, the mounting part 100 may be formed such that the circumferential surface of the opening 45 further extends rearward from the rear surface of the main door 40. Thus, the mounting part 100 may sufficiently secure an area for mounting the basket 200.

The first basket 210 may be provided at the upper portion of the opening 45 and may be spaced apart from an upper surface of the opening 45 by a predetermined interval so that the user may easily approach the accommodation space.

In some implementations, the third basket 230 may be provided at a lower portion of the opening 45 and may be provided on a rear side of the display unit 60. In detail, the display unit 60 may be mounted on a rear surface of the mounting part 100 and the third basket 230 may be provided on a lower surface of the mounting part 100 on the rear side of the display unit 60.

In some implementations, the second basket 220 may be located between the first basket 210 and the third basket 230 and may be spaced apart from the first basket 210 and the third basket 230 by a predetermined interval. Thus, the user may easily approach the accommodation space of the basket 200 through between spaces of the basket 200, which are spaced apart from each other.

First mounting parts 110 on which the first basket 210 is mounted may be formed at upper portions of opposite side surfaces of the mounting part 100, respectively. The first mounting parts 110 may be formed of plated metal for firm fixing of the first basket 210.

In some implementations, the first mounting parts 110 may be fixed by passing through the opposite surfaces of the mounting part 100 and may be provided such that the first basket 210 is insert-mounted thereto from above to below. In detail, each first mounting part 110 may include an extension 111 that extends from a side surface of the mounting part 100 to an inner side of the opening 45 and a bent part 112 that is bent from the extension 111 and extends upward.

Second mounting parts 120 on which the second basket 220 is mounted may be formed approximately at centers of a vertical height on the opposite side surfaces of the mounting part 100. The second basket 220 may be vertically movable. To achieve this, elevation devices 420 (see FIG. 8) may be provided in the second basket 220. In some implementations, the second mounting parts 120 may be recessed in the opposite surfaces of the mounting part 100 to accommodate the elevation devices 420 therein. In some implementations, the second mounting parts 120 may be formed to be vertically elongated such that the elevation devices 420 may vertically move.

Third mounting parts 130 on which the third basket 230 is mounted may be formed at lower portions of the mounting part 100, respectively. The third mounting parts 130 may be formed at opposite left and right ends on the lower surface of the mounting part 110. For example, the third mounting parts 130 may be formed at a pair of edges in which the lower surface and the opposite surfaces of the mounting part 110 are in contact with each other, respectively.

The third mounting parts 130 may be provided such that the third basket 230 is insert-mounted thereto from above to below, and a detailed description of a coupling structure of the third mounting parts 130 and the third basket 230 will be described below again.

The basket 200 may include a basket body that defines an accommodation space for foods and a frame that is mounted to the mounting part 100. In some implementations, the frame may include a frame body that is accommodated in one side of the basket body and is not exposed to the outside and frame mounting parts that are mounted to the mounting part 100. Here, because the frame mounting parts are provided not in the basket body but in the frame, a mounting structure may not be exposed even when the basket body has transparency.

Figure 6:
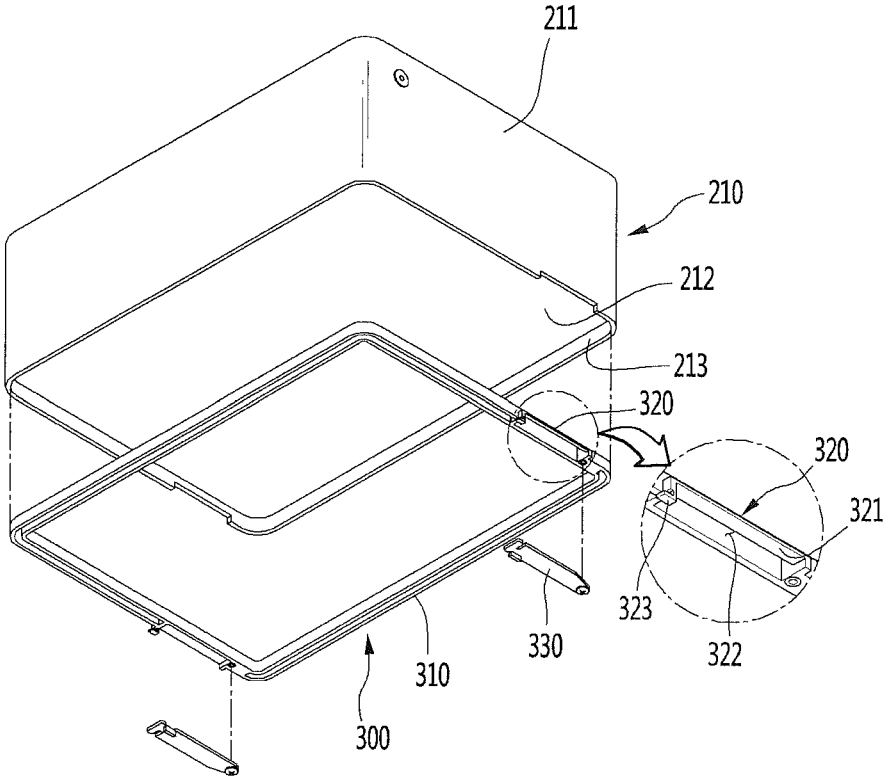
FIG. 6 is an exploded perspective view of an example main structure of a first basket.

FIG. 6 illustrates an example main structure of a first basket. Further, FIG. 7 illustrates an example coupling structure of a first basket and a door.

Figure 7:
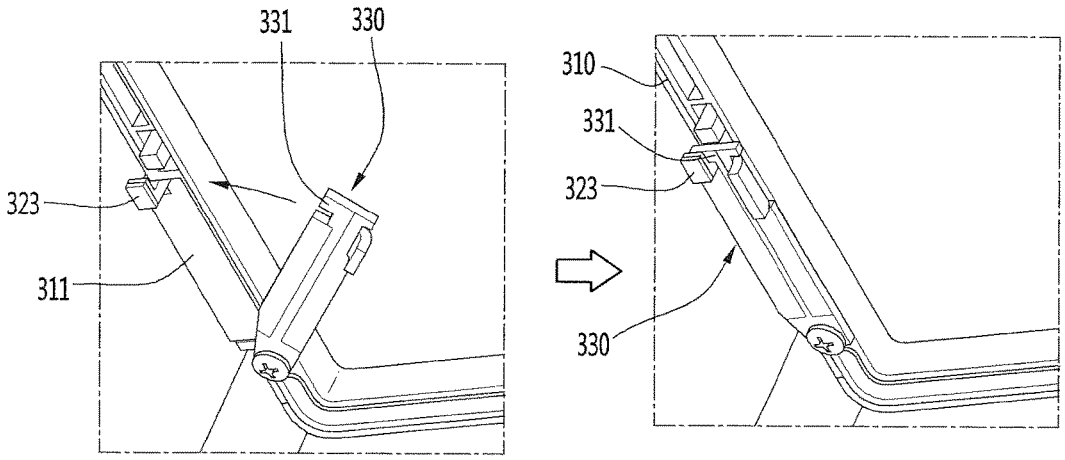
FIG. 7 is a view of an example coupling structure of a first basket and a door.

Referring to FIGS. 6 and 7, the first basket 210 may include a box-shaped first basket body 211 that has an accommodation space that is upward opened, a first basket extension 213 that extends downward from a circumferential end of a lower surface of the first basket body 211, and first basket recessed parts 212 that are defined by a lower surface of the first basket body 211 and the first basket extension 213.

Each first basket recessed part 212 may be defined as a space that is inward recessed in the lower surface of the first basket 210, and a circumferential surface thereof may be defined by the first basket extension 213.

In some implementations, the first basket 210 may include a fixing frame 300 that is inserted into the first basket recessed parts 212.

The fixing frame 300 may support the first basket body 211 and may be mounted on the first mounting parts 110.

The fixing frame 300 may include a fixing frame body 310 that is inserted into the first basket recessed parts 212, fixing mounting parts 320 that are formed at opposite sides of the fixing frame body 310, and fixing members 330 that are rotatably provided in the fixing frame body 310.

The fixing frame body 310 may have an approximately rectangular ring shape. In some implementations, the fixing frame body 310 may be formed to have a size at which it may be inserted into the first basket recessed parts 212 and may be formed to have an outer circumferential surface corresponding to inner circumferential surfaces of the first basket recessed parts 212. For example, when being inserted into the first basket recessed parts 212, the fixing frame body 310 may be fixed to the first basket recessed parts 212 so as not to be moved with respect to the first basket 210 in a state in which an outer peripheral surface thereof is in contact with the first basket extension 213.

The fixing mounting parts 320 may be adapted to mount the fixing frame 300 to the first mounting parts 110 and may be formed at front ends of opposite surfaces of the fixing frame body 310, respectively. In some implementations, the fixing mounting parts 320 may be coupled to the first mounting parts 110, respectively, such that bent parts 112 of the first mounting parts 110 are inserted thereinto and fixed thereto, respectively.

In detail, the fixing mounting parts 320 may be defined by fixing recessed parts 321 that are inward recessed in side surfaces of the fixing frame body 310, respectively.

In some implementations, fixing accommodation parts 322 into which the first mounting parts 110 are inserted may be formed in the fixing recessed parts 321, respectively. Each fixing accommodation part 322 may include a portion in which the extension 111 is accommodated and which is seated on the extension 111 and a portion that extends upward from an inner side of the fixing frame body 310 such that a corresponding bent part 112 is inserted thereinto. Thus, the fixing frame 300 may be inserted such that the first mounting parts 110 are coupled to the fixing recessed parts 321, respectively, to be fixed to the first mounting parts 110.

Fixing protrusions 323 may be formed on one sides of the fixing mounting parts 320, respectively. The fixing protrusions 323 may be selectively caught and restrained by one sides of the fixing members 330 through rotation, respectively. In detail, catching protrusions 331 into which the fixing protrusions 323 are inserted may be formed on one sides of the fixing members 330, respectively.

The fixing members 330 may be provided to shield lower opened surfaces of the fixing accommodation parts 322 through rotation after the first mounting parts 110 are accommodated in the fixing accommodation parts 322, respectively. For example, the fixing members 330 come into contact with lower surfaces of the first mounting parts 110, respectively, so that the fixing frame 300 is more firmly fixed to the first mounting parts 110. To achieve this, the fixing members 330 may be provided to have a plate shape that corresponds to lower surfaces of the fixing accommodation parts 322, respectively.

In some implementations, the fixing members 330 may be caught and restrained by the fixing protrusions 323 through rotation, respectively. In detail, one ends of the fixing members 330 may be rotatably mounted on lateral sides of the fixing mounting parts 320 on opposite sides of the fixing frame body 310, respectively. In detail, the catching protrusions 331 into which the fixing protrusions 323 are inserted may be formed on the other ends of the fixing members 330, respectively.

The first basket recessed parts 212 may be recessed identically to or more deeply than a vertical thickness of the fixing frame 300 so as not to be exposed to the outside of the fixing frame 300. In detail, the first basket extension 213 may extend downward identically to or longer than a vertical thickness of the fixing frame body 310, to accommodate the fixing frame body 310.

In some implementations, portions of the first basket extension 213, which correspond to the fixing mounting parts 320, may be cut such that the fixing frame 300 may be fixed to the first mounting parts 110 through downward movement.

In some implementations, when the fixing frame 300 that is coupled to the first basket 210 is mounted on the first mounting parts 110, opposite surfaces of the first basket 210 come into contact with inner surfaces of the mounting part 100 so that the fixing frame 300 may be not exposed to the outside.

The user moves the fixing frame 300 from above to below so that the first mounting parts 110 may be inserted into the fixing accommodation parts 322, respectively. In some implementations, the lower opened surfaces of the fixing accommodation parts 322 are shielded by rotating the fixing members 330, so that the fixing frame 300 may be fixed so as not to be separated from the first mounting parts 110.

When the fixing members 330 are located to shield the lower opened surfaces of the fixing accommodation parts 323, the catching protrusions 331 are coupled to the fixing protrusions 323, respectively. In some implementations, upper surfaces of the fixing members 330 may cover and support lower surfaces of the first mounting parts 110, respectively. For example, the first mounting parts 110 are located between the fixing recessed parts 321 and the fixing member 300, respectively, so that the fixing frame 300 may be firmly provided in the main door 40 without being moved or being separated from the first mounting parts 110. Thus, the first basket 210 that is coupled to the fixing frame 300 may also be firmly provided in the main door 40 without shaking.

The user may rotate the fixing members 330 such that the lower surfaces of the fixing accommodation parts 332 are opened, and move the fixing frame 300 upward, to separate the fixing frame 300 from the first mounting parts 110.

Here, the fixing frame 300 may be formed of metal. For example, the fixing frame body 310 and the fixing members 330 may be formed of metal. Thus, the fixing frame 300 may be more firmly coupled to the first mounting parts 110 that are formed of metal, may stably support a weight of the first basket 210, and may be prevented from being damaged.

Figure 8:
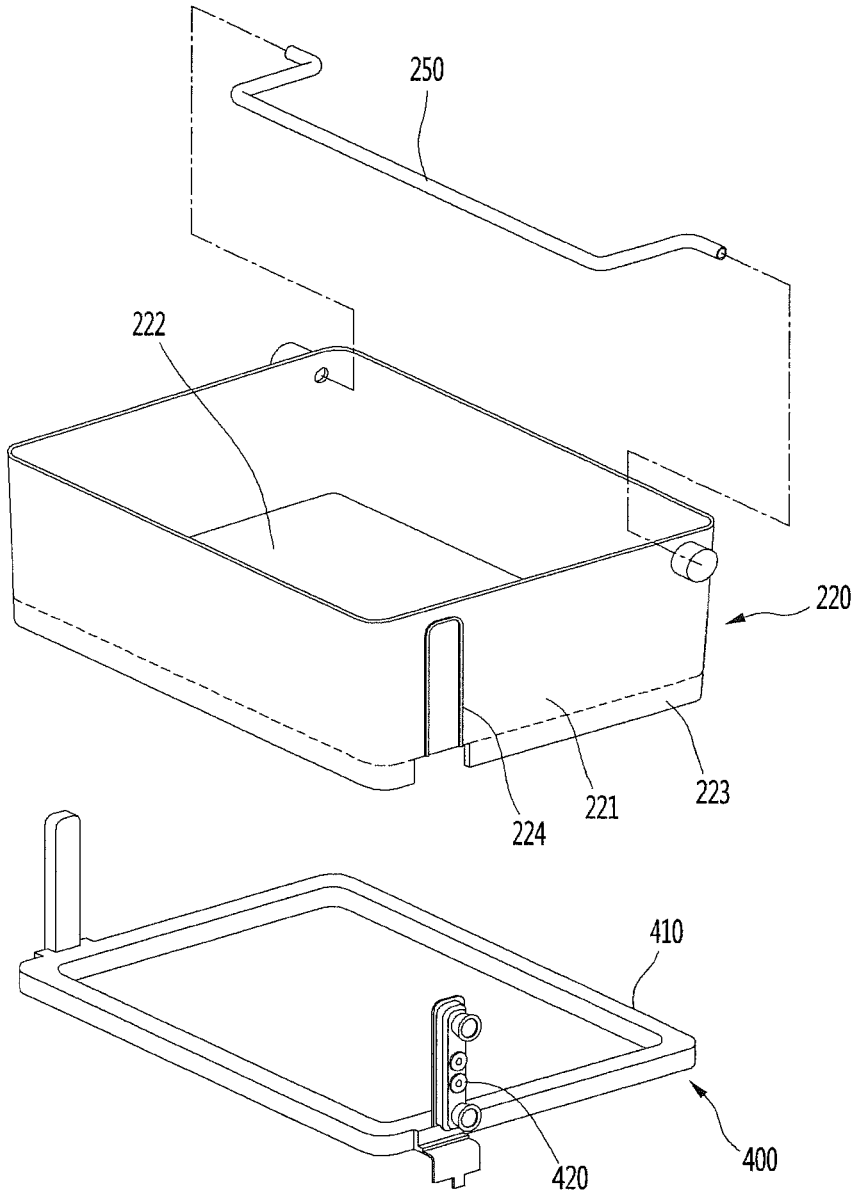
FIG. 8 is an exploded perspective view of an example main structure of a second basket.

FIG. 8 illustrates an example main structure of a second basket.

Referring to FIG. 8, the second basket 220 may include a box-shaped second basket body 221 that has an accommodation space that is upward opened, a second basket extension 223 that extends downward from a circumferential end of a lower surface of the second basket body 221, and second basket recessed parts 222 that are defined by a lower surface of the second basket body 221 and the second basket extension 223.

Each second basket recessed part 222 may be defined as a space that is inward recessed in the lower surface of the second basket 220, and a circumferential surface thereof may be defined by the second basket extension 223.

The second basket 220 may include a movable frame 400 that is inserted into the second basket recessed parts 222.

The movable frame 400 may be provided to support the second basket body 220 and to be mounted on the second mounting parts 120.

The movable frame 400 may include a movable frame body 410 that is inserted into the second basket recessed parts 222 and elevation devices 420 that are provided on opposite sides of the movable frame body 410 to enable vertical movement of the movable frame 400.

The movable frame body 410 may have an approximately rectangular ring shape. In some implementations, the movable frame body 410 may be formed to have a size at which it may be inserted into the second basket recessed parts 222 and may be formed to have an outer circumferential surface corresponding to inner circumferential surfaces of the second basket recessed parts 222. For example, when being inserted into the second basket recessed parts 222, the movable frame body 410 may be coupled to the second basket recessed parts 222 so as not to be moved with respect to the second basket 220 in a state in which an outer peripheral surface thereof is in contact with the second basket extension 223.

The elevation devices 420 may be provided at front ends of opposite surfaces of the movable frame body 410. In some implementations, the elevation devices 420 may be inserted into the second mounting parts 120, respectively. In some implementations, the elevation devices 420 may be provided to be vertically movable along extension directions of the second mounting parts 120, respectively. In some implementations, when the movable frame 400 is located at an intended height, a location thereof may be fixed by the second mounting parts 120.

In detail, the elevation devices 420 may be provided to protrude outward from the opposite surfaces of the movable frame body 410, respectively. In some implementations, rails that guide vertical movements of the elevation devices 420 may be included inside the second mounting parts 120, respectively. In some implementations, rollers that are rotated when the elevation devices 420 are vertically moved along the rails may be provided in the elevation devices 420, respectively.

In some implementations, levers that fix the elevation devices 420 to the second mounting parts 120 at an intended height by manipulation of the user may be included in the elevation devices 420, respectively. Thus, the elevation devices 420 may be unrestrained by manipulation of the levers to vertically move along the rails of the second mounting parts 120 or to be fixed, respectively. In some implementations, the second basket 220 that has the elevation devices 420 may be vertically moved or fixed.

Elevation device accommodating parts 224 that are inward recessed may be formed on opposite surfaces of the second basket body 221, respectively. The elevation device accommodating parts 224 are formed to accommodate portions of the elevation devices 420, respectively, so that the elevation devices 420 are not exposed to the outside. For example, when the portions of the elevation devices 420 are exposed to the outsides of the second mounting parts 120, respectively, the elevation device accommodating parts 224 accommodate them, so that the elevation devices 420 may not be exposed to the outside.

The second basket recessed parts 222 may be recessed identically to or more deeply than a vertical thickness of the movable frame 400 so as not to be exposed to the outside of the movable frame 400. In detail, the second basket extension 223 may extend downward identically to or longer than a vertical thickness of the movable frame body 410, to accommodate the movable frame body 410.

In some implementations, portions of the second basket extension 223, which correspond to the elevation devices 420, may be cut so as not to interfere in the elevation devices 420, respectively.

In some implementations, when the movable frame 400 that is coupled to the second basket 220 is mounted on the second mounting parts 120, the elevation devices 420 are accommodated in the elevation device accommodating parts 224 and the second mounting parts 120, respectively, and opposite surfaces of the second basket 220 come into contact with inner surfaces of the mounting part 100 so that the movable frame 400 may be not exposed to the outside.

Figure 9:
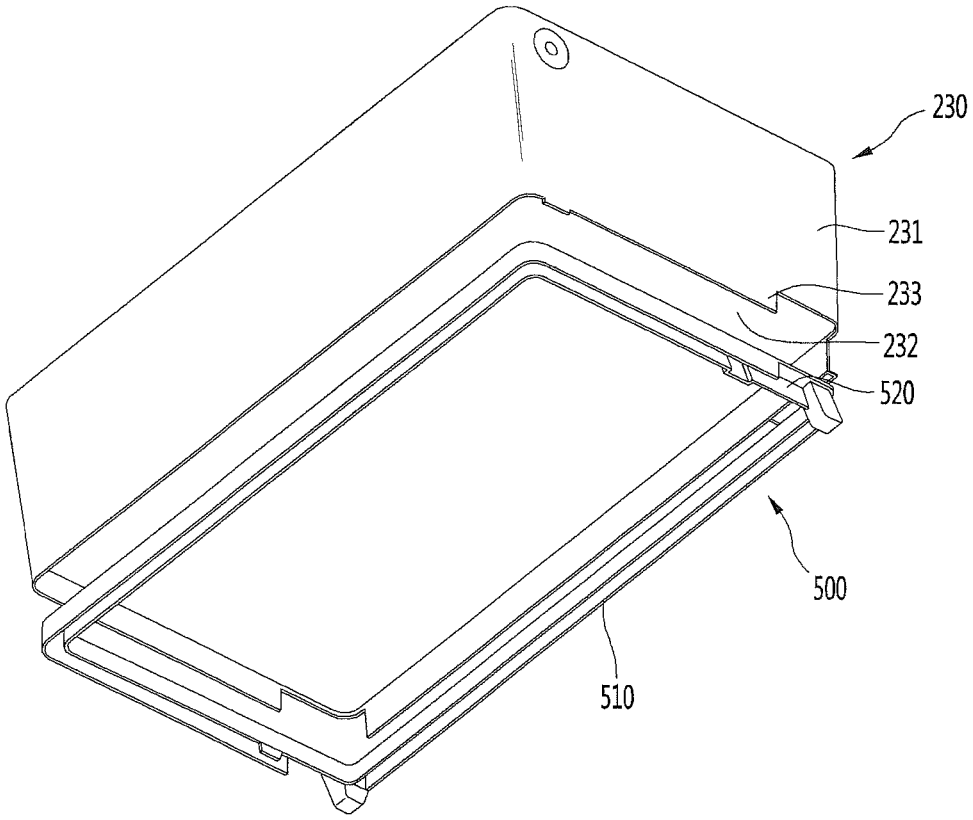
FIG. 9 is an exploded perspective view of an example main structure of a third basket.
Figure 10:
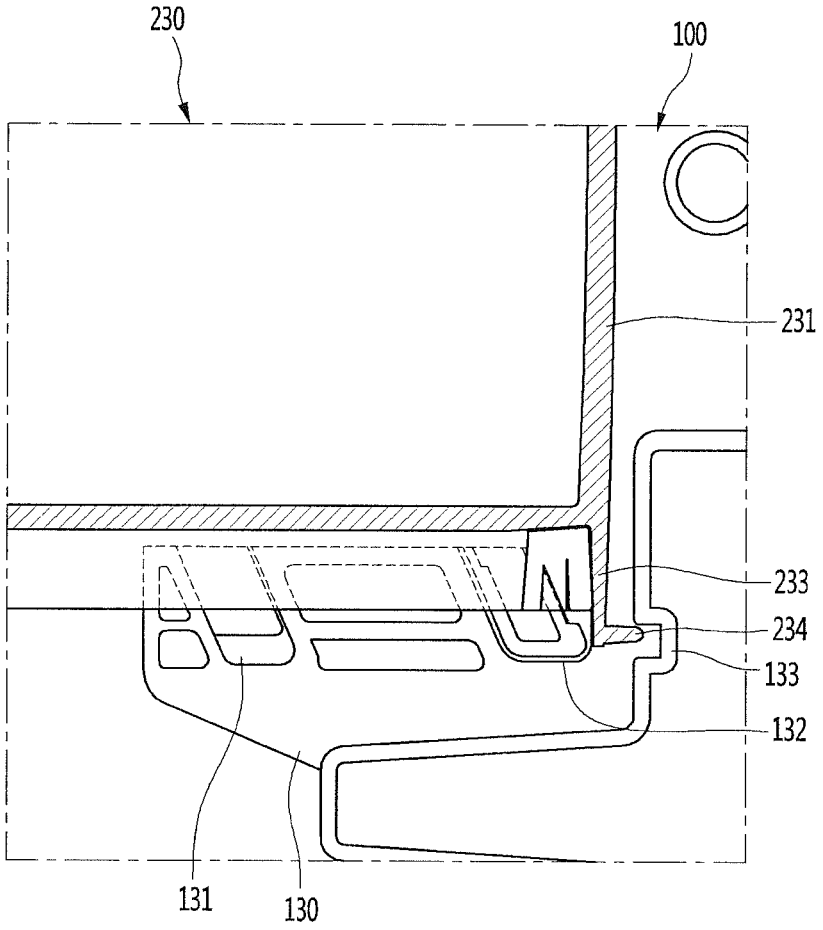
FIG. 10 is a view of an example coupling structure of a third basket and a door.

FIG. 9 illustrates an example main structure of a third basket. Further, FIG. 10 illustrates an example coupling structure of a third basket and a door.

The third basket 230 may include a box-shaped third basket body 231 that has an accommodation space that is upward opened, a third basket extension 233 that extends downward from a circumferential end of a lower surface of the third basket body 231, and third basket recessed parts 232 that are defined by a lower surface of the third basket body 231 and the third basket extension 233.

Each third basket recessed part 232 may be defined as a space that is inward recessed in the lower surface of the third basket 230 and a circumferential surface thereof may be defined by the third basket extension 233.

The third basket 230 may include a seating frame 500 that is inserted into the third basket recessed parts 232.

The seating frame 500 may be provided to support the third basket body 230 and to be mounted on the third mounting parts 130.

The seating frame 500 may include a seating frame body 510 that is inserted into the third basket recessed parts 232 and seating mounting parts 520 that are formed on opposite sides of the seating frame body 510 such that the seating frame 500 is fixed to the third mounting parts 130.

The seating frame body 510 may have an approximately rectangular ring shape. In some implementations, the seating frame body 510 may be formed to have a size at which it may be inserted into the third basket recessed parts 232 and may be formed to have an outer circumferential surface corresponding to inner circumferential surfaces of the third basket recessed parts 232. For example, when being inserted into the third basket recessed parts 232, the seating frame body 510 may be coupled to the third basket recessed parts 232 so as not to be moved with respect to the third basket 230 in a state in which an outer peripheral surface thereof is in contact with the third basket extension 233.

Seating mounting parts 520 that are coupled to the third mounting parts 130 may be formed at front ends of opposite left and right sides of the seating frame body 510, respectively. The seating mounting parts 520 may be recessed in a lower surface of the seating frame body 510 to accommodate at least portions of the third mounting parts 130.

In some implementations, seating frame protrusions that protrude downward may be formed on inner upper surfaces of the seating mounting parts 520 that are recessed in the lower surface of the seating frame body 510, respectively. The seating frame protrusions are provided to be fitted in the third mounting parts 130, respectively, such that the seating frame 500 is fixed to the third mounting parts 130. In detail, each seating frame protrusion includes a front protrusion 522 that is formed on an inner front side of a corresponding seating mounting part 520 and a rear protrusion 521 that is formed on a rear side of the front protrusion 522 on an inner side of the seating mounting part 520. The plurality of seating frame protrusions each having the rear protrusion 521 and the front protrusion 522 are provided so that the seating frame 500 is firmly fixed to the third mounting parts 130.

The third mounting parts 130 may be formed at opposite left and right ends of the lower surface of the mounting part 110. In some implementations, each third mounting part 130 may have a portion formed therein to spaced apart from the mounting part 110 and extend upward such that the third mounting part 130 may be inserted into a corresponding seating mounting part 520.

In some implementations, protrusion inserting parts into which the seating frame protrusions are inserted may be formed in the third mounting parts 130, respectively. The protrusion inserting parts may be recessed in a depth corresponding to a length by which the seating frame protrusions protrude, such that the seating frame protrusions are completely inserted thereinto, respectively. In some implementations, the protrusion inserting parts may be coupled to the seating frame protrusions when the seating frame protrusions are fitted therein, respectively. Here, the protrusion inserting parts may be formed at portions of the seating mounting parts 520, which extend upward, respectively.

Each protrusion inserting part may include a rear protrusion inserting part 131 into which the rear protrusion 521 is inserted and a front protrusion inserting part 132 into which the front protrusion 522 is inserted. The rear protrusion inserting part 131 and the front protrusion inserting part 132 are formed at locations corresponding to the rear protrusion 521 and the front protrusion 522, respectively.

A protrusion step 140 that protrudes upward is formed on the lower surface of the mounting part 100. The protrusion step 140 may be formed approximately at a front end of the lower surface of the mounting part 100. In some implementations, the display unit 60 may be mounted on the protrusion step 140. In some implementations, the third basket 230 may be arranged on a rear side of the protrusion step 140, and the third basket 230 is supported by the protrusion step 140.

In some implementations, catching parts 234 that protrude forward may be formed in the third basket extension 233. In detail, the catching parts 234 may be formed at portions of the third basket extension 233, which face the protrusion step 140 of the third basket body 231. In some implementations, catching part supporting parts 133 into which the catching parts 234 are inserted may be recessed in a rear surface of the protrusion step 140. The pair of catching parts 234 may be formed at ends of the third basket extension 233 to be spaced apart from each other and the catching part supporting parts 133 may be formed at locations corresponding to the catching parts 234, respectively.

The catching parts 234 may protrude forward from the third basket extension 233. Thus, the catching parts 234 may be inserted into the catching part supporting parts 133, respectively, as the third basket 230 is moved from rear to front. Here, when the seating frame protrusions are inserted into the protrusion inserting parts, respectively, the catching parts 234 may be inserted into the catching part supporting parts 133, respectively.

The seating frame protrusions and the protrusion inserting parts may be inclined from rear to front as they go downward. In detail, front and rear surfaces of the seating frame protrusions may be inclined as they go downward. In some implementations, the protrusion inserting parts may be recessed to have the same slope as that of the seating frame protrusions to be coupled to the seating frame protrusions.

Thus, the seating frame 500 that is coupled to the third basket body 231 may be mounted on the third mounting part 130 as it moves from above to below, and at the same time moves forward. In some implementations, when the seating frame protrusions are inserted into the protrusion inserting parts, respectively, the catching parts 234 may be inserted into the catching part supporting parts 133, respectively, as they become closer to the rear surface of the protrusion step 140.

The third basket 230 may be firmly mounted on the main door 40 through coupling between the seating frame protrusions and the protrusion inserting parts and coupling between the catching parts 234 and the catching part supporting parts 133.

The third basket recessed parts 232 may be recessed identically to or more deeply than a vertical thickness of the seating frame 500 so as not to be exposed to the outside of the seating frame 500. In detail, the third basket extension 233 may extend downward by an interval that is identical to or longer than a vertical thickness of the seating frame body 510, to accommodate the seating frame body 510.

In some implementations, portions of the third basket extension 233, which correspond to the seating mounting parts 520, may be cut such that the seating frame 500 may be fixed to the third mounting parts 130 through downward movement, respectively.

In some implementations, when the seating frame 500 that is coupled to the third basket 230 is mounted on the third mounting parts 130, opposite side surfaces of the third basket 230 come into contact with inner surfaces of the mounting part 100 so that the seating frame 500 may be not exposed to the outside.

The mounting part 100 may be injection-molded using plastic materials. In some implementations, the third mounting parts 130 may be injection-molded integrally with the mounting part 100 or may be provided as a separate injection-molded product, to be mounted on the mounting part 100. In some implementations, the seating frame 500 is also injection-molded using plastic materials so that a shape of the seating mounting parts 520 may be formed with low manufacturing costs.

In some implementations, a plurality of baskets may be mounted on rear surfaces of the refrigerating chamber doors 20 and the freezing chamber doors 30 that are not dually opened/closed, and these baskets refer to door baskets 240. Each of the refrigerating chamber doors 20 and the freezing chamber doors 30 may be formed to have the same width. In this case, all the door baskets 240 that are mounted on the refrigerating chamber doors 20 and the freezing chamber doors 30 may have the same shape and may be separably mounted on desired doors.

Hereinafter, a structure and a mounting structure of the door baskets 240 will be described. Hereinafter, a state in which the door baskets 240 are mounted on the freezing chamber doors 30 will be illustratively described for convenience of description and understanding. However, it is obvious that the door baskets 240 may be mounted on all the refrigerator doors regardless of a shape of a refrigerator and a shape of a door.

Figure 11:
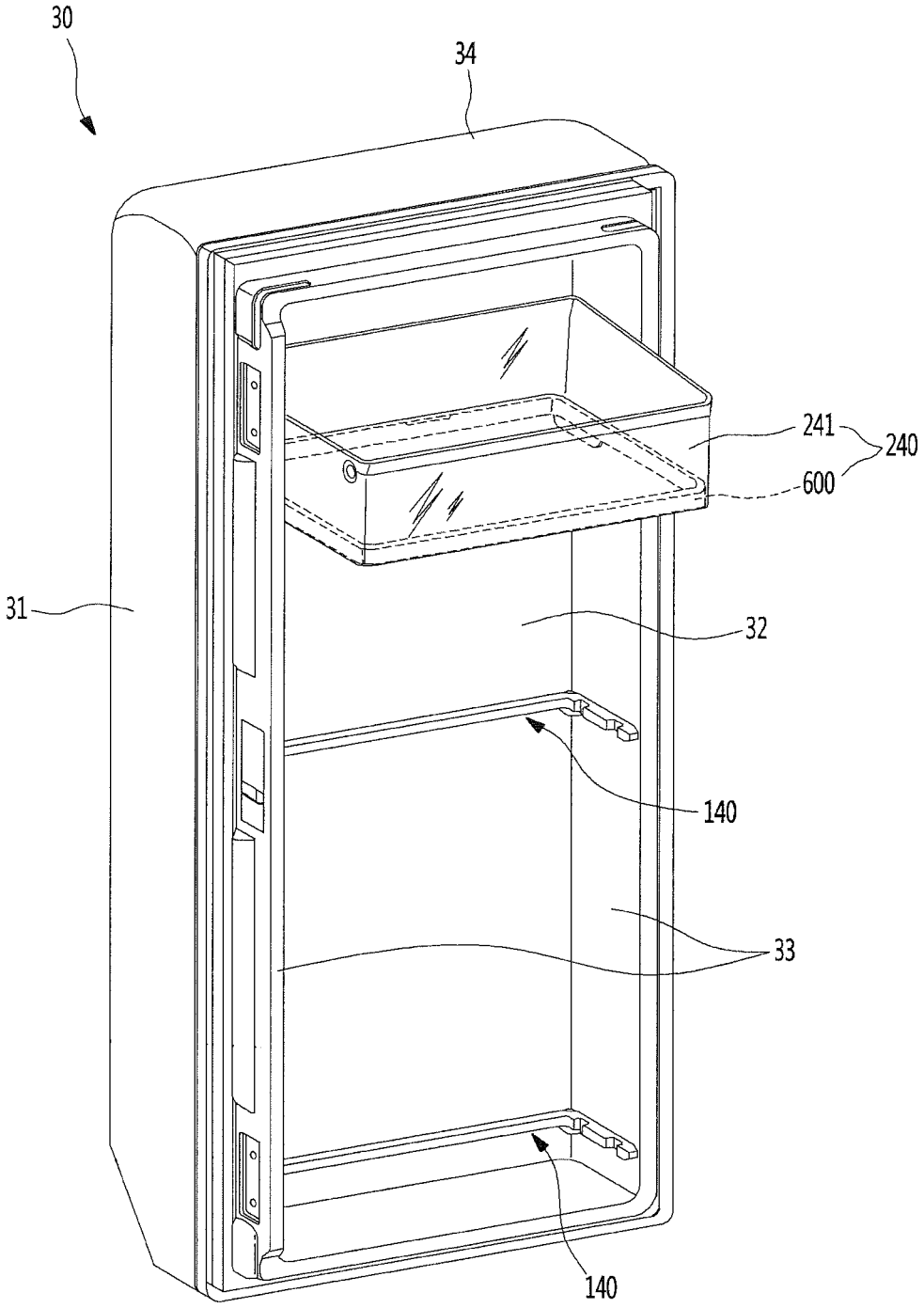
FIG. 11 is a rear perspective view of an example door of a refrigerator.
Figure 12:
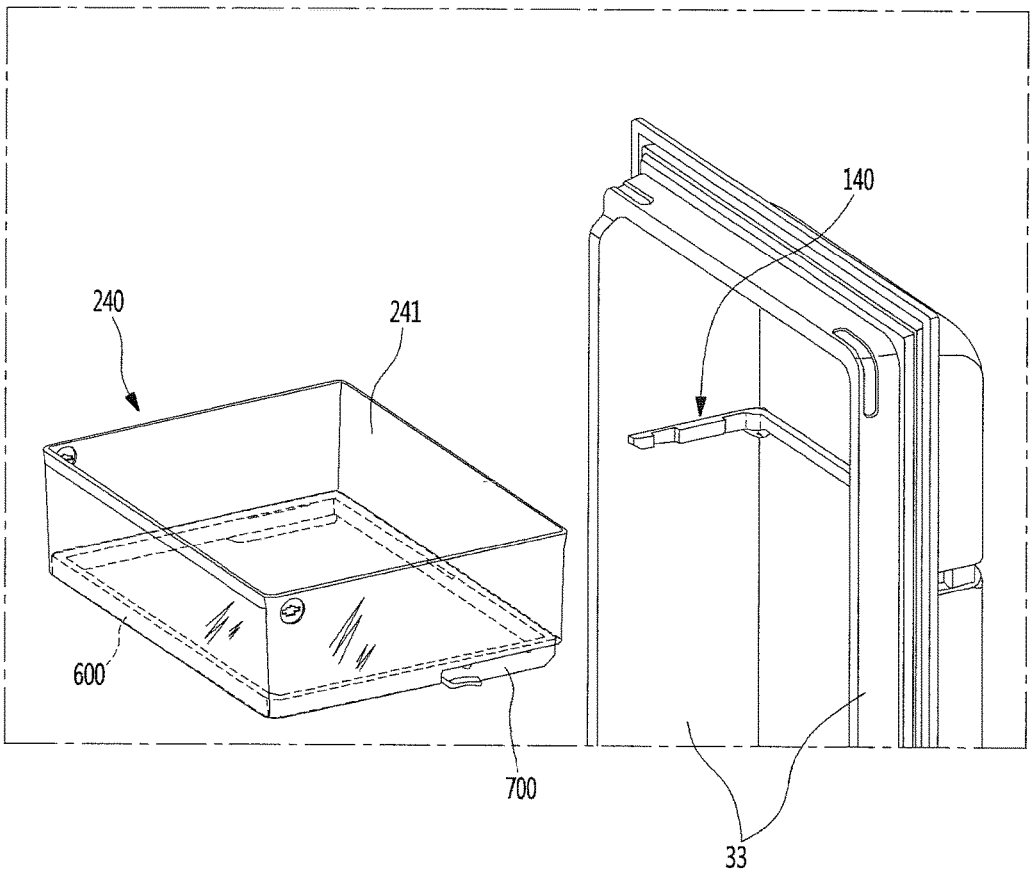
FIG. 12 is an exploded perspective view of an example coupling structure of a door and a door basket.

FIG. 11 illustrates an example door of a refrigerator. Further, FIG. 12 illustrates an example coupling structure of a door and a door basket.

As illustrated in the drawings, an outer appearance of each freezing chamber door 30 (hereinafter, referred to as a door 30) is entirely defined by an out case 31 and an internal shape of the door 30 may be defined by a door liner 32. In some implementations, cap decorations 34 may be mounted on an upper end and a lower end of the door 30 and an insulating material (not illustrated) may be formed, through foaming, in an internal space that is defined by the out case 31, the door liner 32 and the cap decorations 34.

The out case 31 may be formed by bending a steel plate and may be formed of various materials, as needed, to define an outer appearance of the refrigerator 1. In some implementations, the door liner 32 may be injection-molded using resin and may provide a structure to/from which the door baskets 240 may be attached/detached, on a rear surface of the door 30.

For example, door dikes 33 that extend along edges of the door 30 may be formed in the door liner 32 and door mounting parts 140 may be formed in the door dikes 33 so that the door baskets 240 are mounted thereto.

The door mounting parts 140 may be formed in the door dikes 33 on opposite left and right sides of the door 30 and may be connected to the door dikes 33 between the door dikes 33. In some implementations, the plurality of door mounting parts 140 may be vertically formed. Thus, the user may determine a mounting location of the door 30 by mounting the door baskets 240 at a desired height. In some implementations, the plurality of door baskets 240 may also be mounted on the plurality of door mounting parts 140, respectively, and a proper accommodation environment may be configured depending on accommodated foods.

Each door basket 240 may be fixed to a rear surface of the door 30 while being mounted on a corresponding door mounting part 140. In some implementations, opposite left and right surfaces and a rear surface of the door basket 240 are supported by the door mounting part 140 so that a stable mounting state may be maintained.

The door baskets 240 may further protrude from the door dikes 33 while being mounted on the door 30. The door baskets 240 may protrude by a length at which accommodation members within the refrigerator do not interfere in each other when the door 30 is closed.

The door basket 240 includes a door basket body 241 and a door frame 600. The door basket body 241, which defines an accommodation space, may be formed of a transparent or semi-transparent material such that the user may see through an interior of the accommodation space. The door frame 600 may be formed at a lower end of the door basket 240.

Frame mounting parts 700 that are coupled to the door mounting part 140 are formed on opposite surfaces of the door frame 600 so that the door basket 240 may be mounted on the rear surface of the door 30. In some implementations, the door mounting part 140 is covered by the door frame 600 while being coupled to the frame mounting parts 700 so that the door mounting part 140 may be directly exposed to the outside or may be covered by the transparent accommodation member without being exposed.

Figure 13:
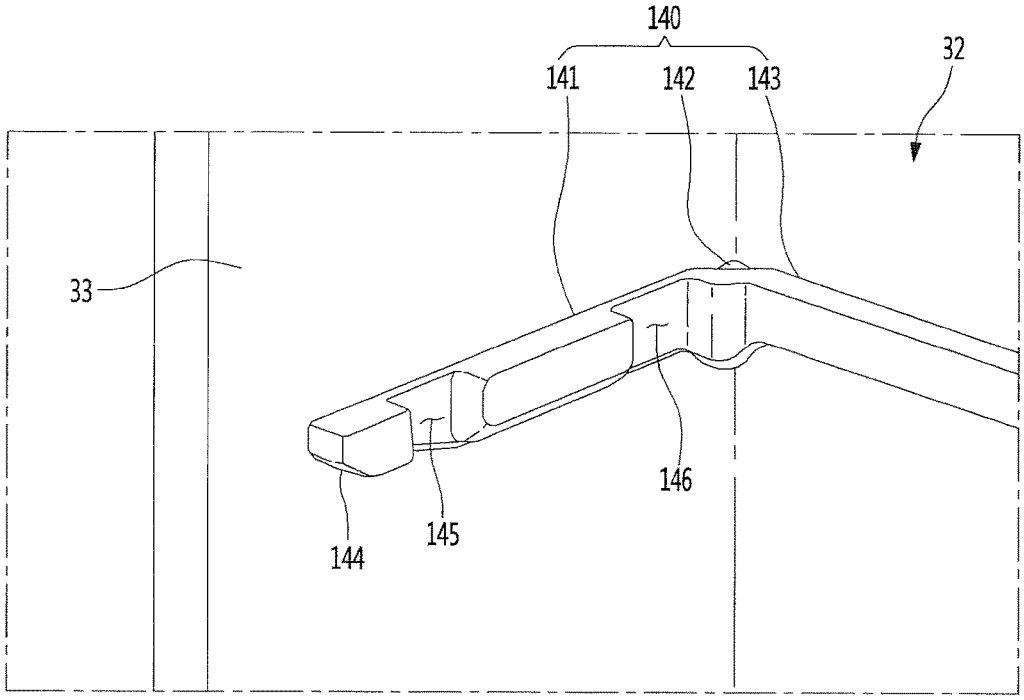
FIG. 13 is an enlarged view of a shape of an example mounting part that is located in a door.

FIG. 13 illustrates a shape of an example door mounting part that is located in a door.

Referring to the drawings, the door mounting part 140 may include a pair of side surfaces 141 that are formed on inner surfaces of the door dikes 33 on opposite left and right sides and a rear surface 143 that connects the pair of side surfaces 141 to each other.

The rear surface 143 may be formed to cross an inner surface of the door 30, for example, a surface that is in contact with a rear surface of the door basket 240 when the door basket 240 is mounted. In some implementations, opposite ends of the rear surface 143 may be connected to the pair of side surfaces 141, respectively, so that the door mounting part 140 may be formed to have a shape that entirely horizontally cross the inner surface of the door 30.

In some implementations, the rear surface 143 may not be formed to cross the entire inner surface of the door 30, but may extend from opposite ends of the pair of side surfaces 141 such that the opposite ends are spaced apart from each other. For example, the door mounting part 140 may be formed only at inner edges of the door 30.

In some implementations, forming parts 142 may be formed at edges at which the side surfaces 141 and the rear surface 143 are connected to each other. The forming parts 142 extend such that edges of the door mounting part 140 and edges of the door liner 32 are connected to each other through a gentle slope or a round. Thus, when the door liner 32 is vacuum-formed, wrinkles or defects may be prevented from being generated at the edges.

The side surfaces 141 may extend from rear ends to front sides of the door dikes 33, respectively, and may extend in parallel to a bottom surface of the door basket 240. In some implementations, the side surfaces 141 may extend from the rear ends of the door dikes 33 to protruding ends of the door dikes 33 or one sides that are adjacent to the ends, respectively.

Inclined surfaces 144 may be formed on lower surfaces of front ends of the side surfaces 141, respectively. Thus, the side surfaces 141 may be formed to have a vertical thickness that becomes thicker as they go from a front end to a rear end thereof on an area of the inclined surfaces 144.

First fixing grooves 145 may be formed on the side surfaces 141, respectively. The first fixing grooves 145 may be recessed vertically to the side surfaces 141, respectively, and may be formed such that first fixing protrusions 703, which will be described below, may be inserted thereinto, respectively.

In some implementations, second fixing grooves 146 may be further formed on rear sides of the first fixing grooves 145, respectively. The second fixing grooves 146 may be located on rear sides of the first fixing grooves 145 at an interval, respectively, and may be formed such that second fixing protrusions 704, which will be described below, may be inserted thereinto, respectively. The first fixing grooves 145 and the second fixing grooves 146 may be formed such that the first fixing protrusions 703 and the second fixing protrusions 704 are caught thereby, respectively, and may have either a shape that is downward recessed in an upper surface of the side surfaces 141 or a shape that vertically passes through the side surfaces 141.

Figure 14:
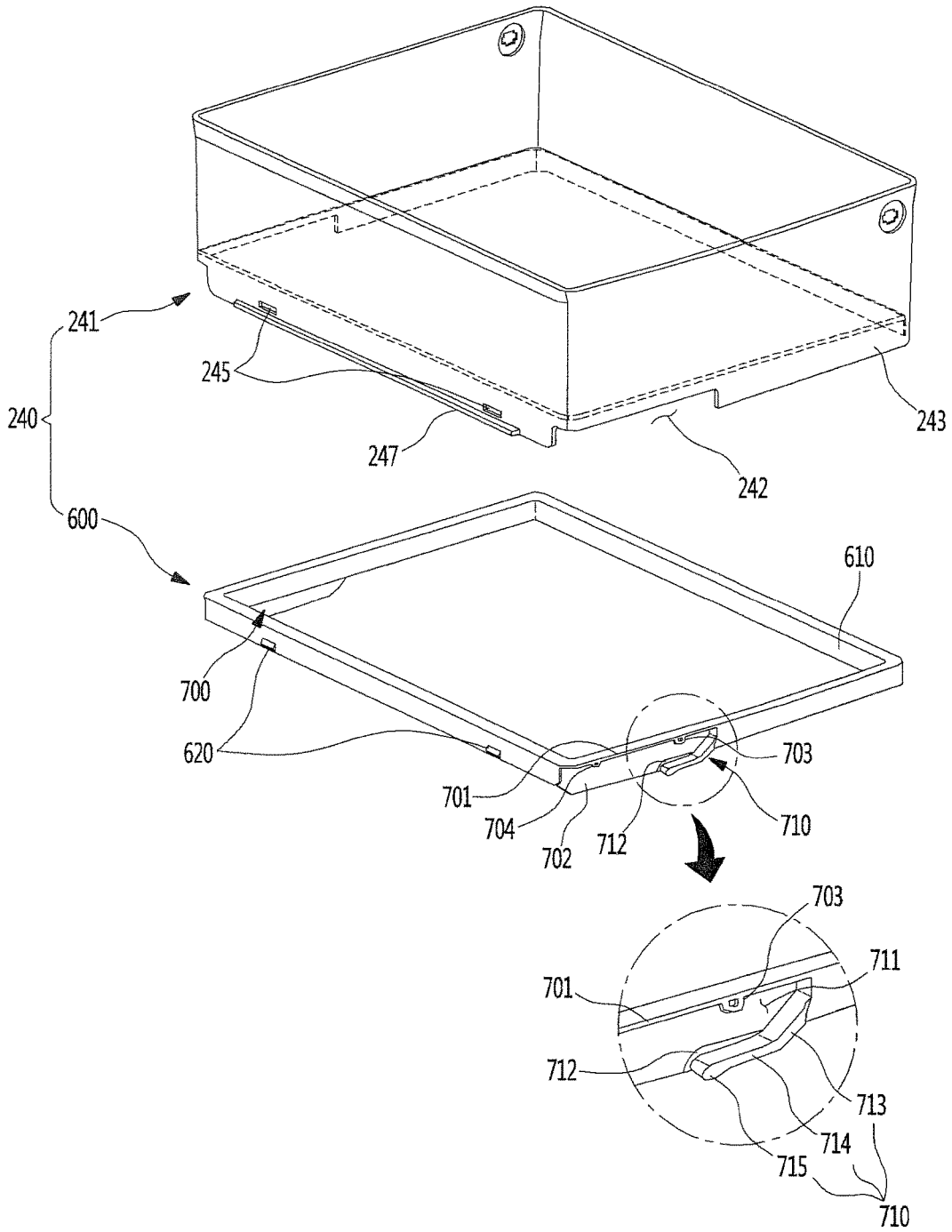
FIG. 14 is an exploded perspective view of an example door basket viewed from above.
Figure 15:
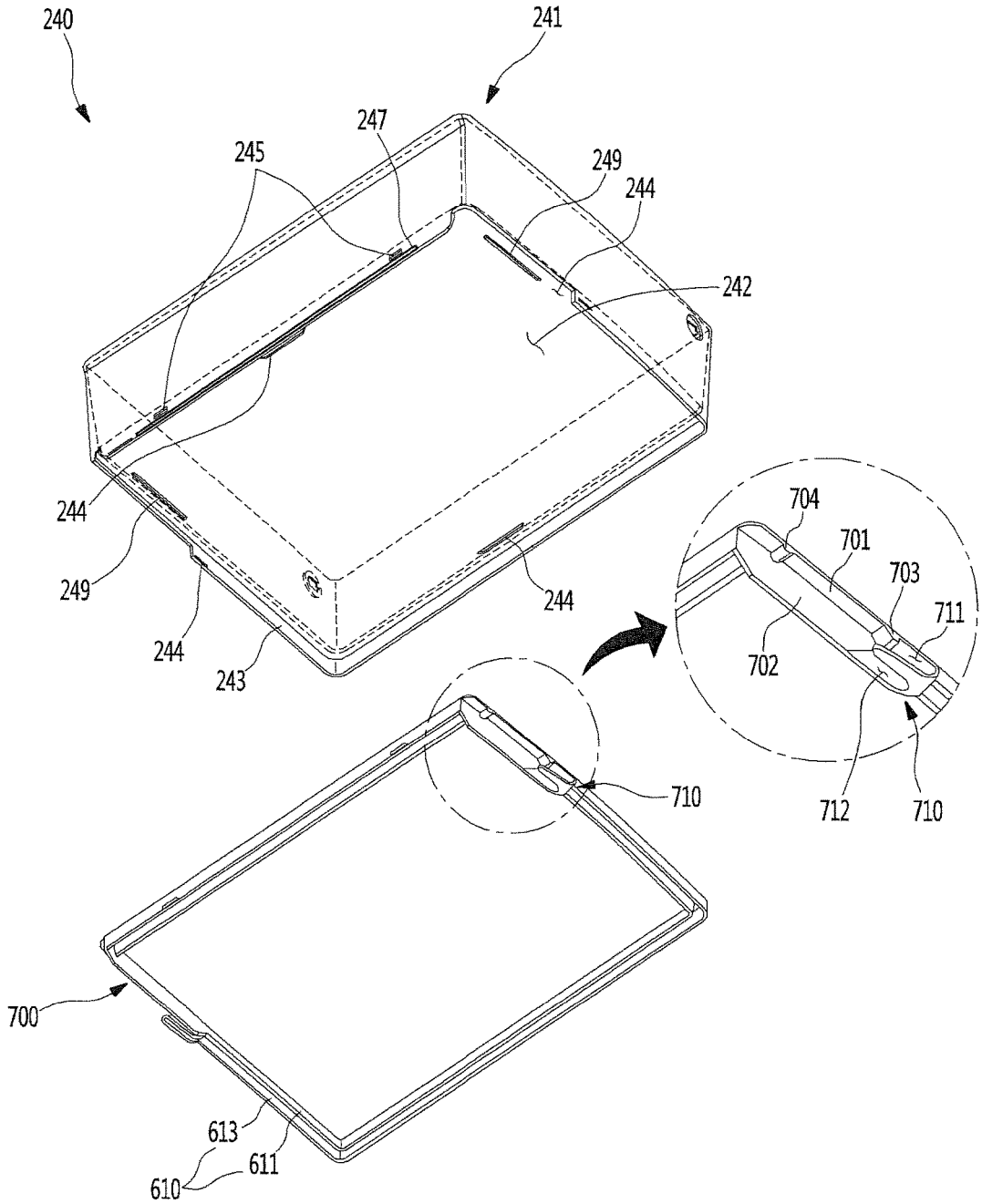
FIG. 15 is an exploded perspective view of an example door basket viewed from below.

FIGS. 14 and 15 illustrate example door baskets.

As illustrated in the drawings, the door basket 240 may include the box-shaped second basket body 241 that has an accommodation space that is upward opened, a door basket extension 243 that extends downward from the circumferential end of the lower surface of the second basket body 241, and door basket recessed parts 242 that are defined by a lower surface of the door basket body 241 and the door basket extension 243.

Each door basket recessed part 242 may be defined as a space that is inward recessed in the lower surface of the door basket 240 and a circumferential surface thereof may be defined by the door basket extension 243. The door frame 600 may be inserted into the door basket recessed parts 242.

The door frame 600 may support the door basket body 241 and may be mounted on the door mounting part 140. The door frame 600 may include a door frame body 610 that is inserted into the door basket recessed parts 242.

The door basket body 241 may have a rectangular basket shape, an upper surface of which is opened. In some implementations, the door basket body 241 is not limited to a completely transparent shape. A horizontal width of the door basket body 241 may be formed to correspond to a width between the pair of door dikes 33 and a front-rear width thereof may be formed to be longer than a protruding height of the door dikes 33.

The height of the door basket extension 243 may be formed identically to or slightly larger than a thickness of the door frame body 610. Thus, the door frame 600 may be located on a lower surface of the door basket body 241 and may be accommodated in the door basket extension 243.

In some implementations, restraint protrusions 244 that protrude toward an inner space of the door basket extension 243 may be formed at a lower end of the door basket extension 243. When the door frame 600 is mounted on an interior of the door basket extension 243, the restraint protrusions 244 restrain the lower end of the door frame 600 to maintain a state in which the door frame 600 is not separated but adjusted. The restraint protrusions 244 may be formed on opposite left and right sides corresponding to the frame mounting parts 700 to which forces are applied when the door basket 240 is mounted or separated, and may also be formed on rear sides that are not exposed to the outside when the door basket 240 is mounted. In some implementations, the plurality of restraint protrusions 244 may be formed, as needed.

In some implementations, coupling grooves 245 may be formed in portions of the door basket extension 243, which correspond to the rear surface (left surface in FIG. 14) of the door basket 240. The coupling grooves 245 may be formed on opposite left and right sides of the door basket extension 243 and may be plural as needed. The coupling grooves 245, into which coupling protrusions 620 that protrude from the rear surface of the door frame 600 are inserted, may maintain a state in which the door basket body 241 and the door frame 600 are more firmly coupled to each other. In some implementations, the coupling grooves 245 and the coupling protrusions 620 are located on the rear surface of the door basket 240, and thus are not exposed to the outside when the door basket 240 is mounted.

In some implementations, a support rib 247 that protrudes rearward may be formed at a lower end of the door basket extension 243, which corresponds to the lower surface of the door basket 240. The support rib 247 may protrude to come into contact with the lower surface of the rear surface 143 of the door mounting part 140 when the door basket 240 is mounted. Thus, when a load is applied to the door basket 240, the support rib 247 may support a rear end of the door basket 240 to maintain a stable fixing mounting state.

Restraint ribs 249 may be further formed on the lower surface of the door basket body 241. The restraint ribs 249 may be formed to be elongated at locations that are spaced apart from the door basket extension 243 by an interval corresponding to a width of the door frame 600. The restraint ribs 249 may be spaced apart from front and rear surfaces of the door basket 240 and the door basket extension 243 on opposite left and right sides of the door basket 240 and may support the door frame 600 on an inner side of the door frame 600.

When the door frame 600 is mounted on the lower surface of the door basket body 241, an outer surface of the door frame 600 comes into close contact with an inner surface of the door basket extension 243, so that primary fixing may be achieved. In some implementations, secondary fixing may be performed such that the door frame 600 is prevented from being downward separated by the restraint protrusions 244, tertiary fixing may be achieved by the coupling grooves 245 and the coupling protrusions 620, and quartic fixing may be achieved by the restraint ribs 249. Thus, in a state in which the door frame 600 to which a weight is intensively applied when the door basket is mounted is stably mounted without being separated from the door basket body 241 may be maintained.

The door frame 600 may be formed to have a shape corresponding to the lower surface of the door basket body 241 and may be formed along a circumference of the lower surface of the door basket body 241. The door frame 600 may be injection-molded using an opaque material and may become opaque through surface treatment of the injection-molded surface using at least one scheme of metal deposition, painting, printing and coating, as needed.

Thus, the door frame 600 may define an outer appearance of a lower circumference of the door basket 240 while being mounted in the door basket extension 243 and may define an opaque area, unlike the space in which foods are accommodated.

The door frame 600 may have a structure that is formed separately from the door basket body 241 and is coupled, but may be formed through double injection molding when the door basket body 241 is formed or may be formed by opaquely treating a lower end using at least one of metal deposition, painting, printing and coating after the door basket body 241 is formed, as needed.

The door frame 600 may be formed to have a rectangular frame shape and may entirely include an inner part 611 and an outer part 613 that are spaced apart from each other and have a rib shape. Upper ends of the inner part 611 and the outer part 613 are connected to each other to define an upper surface and are in contact with the lower surface of the door basket body 241. In some implementations, the outer part 613 may be in close contact with the door basket extension 243.

The coupling protrusions 620 may protrude from a portion of the outer part 613, which defines the rear surface. In some implementations, in a state in which the door frame 600 is mounted on the door basket body 241, a lower end of the outer part 613 may be caught and restrained by the restraint protrusions 244.

The frame mounting parts 700 may be formed on opposite left and right sides of the door frame 600. The frame mounting parts 700 may be formed on rear sides of opposite surfaces of the door basket 240 and may be formed to have a corresponding shape such that door mounting parts 140 may be accommodated therein.

Each frame mounting part 700 may include an upper surface 701 and a side surface 702. The upper surface 701 may define an upper surface of the door frame 600 and an upper surface of the frame mounting part 700. In some implementations, the first fixing protrusions 703 and the second fixing protrusions 704 may protrude downward from the upper surface of the frame mounting part 700. The first fixing protrusions 703 and the second fixing protrusions 704 may be formed at locations corresponding to first fixing grooves 145 and second fixing grooves 146, respectively.

Each first fixing protrusion 703 and each second fixing protrusion 704 may have front surfaces 703*a* and 704*a* (see FIG. 16) and rear surfaces 703*b* and 704*b* (see FIG. 16) that are inclinedly formed, respectively, such that the rear surfaces 703*b* and 704*b* may have a gentler slope than the front surfaces 703*a* and 704*a*. Thus, when the door basket 240 is mounted, if front ends of side surfaces 141 and upper surfaces of the side surfaces 141 come into contact with the first fixing protrusions 703 and the second fixing protrusions 704, respectively, the side surfaces 141 come into contact with the rear surfaces 703*b* and 704*b* having a gentle slope, respectively, so that smooth mounting may be achieved.

In some implementations, the front surfaces 703*a* and 704*a* may be formed to be vertical to a bottom of the door basket 240 or to have a slope corresponding thereto, as needed. Thus, in a state in which the door basket 240 is completely mounted, the front surfaces of the first fixing protrusions 703 and the second fixing protrusions 704 may be restrained by the first fixing grooves 145 and the second fixing grooves 146 and may thus be not easily separated therefrom, respectively.

The side surface 702 may correspond to a portion of the inner part 611 and may extend lower than a height of the door basket extension 243. In a state in which the door basket 240 is mounted on the door 30, the side surfaces of the frame mounting parts 700 may be formed to cover the entire side surfaces 141 of the door mounting parts 140, respectively. For example, the side surfaces may extend to be lower than the lower ends of the side surfaces 141, respectively.

A resilient part 710 may be formed at a front end of the side surface 702. The resilient part 710 may extend from a front end of the frame mounting part 700 along the side surface 702 and may have a plate shape having a predetermined width such that it may be in contact with a lower surface of a corresponding side surface 141.

The resilient part 710 may extend to have a predetermined length such that the side surface 141 may be inserted and accommodated therein and may have a guide groove 711 which is spaced apart from the upper surface of the frame mounting part 700 and into which the side surface 141 is inserted.

In some implementations, the resilient part 710 may be formed to correspond to a shape of a front side of the side surface 141 such that the side surface 141 and the guide groove 711 are coupled to each other when the front side of the side surface 141 is inserted into the guide groove 711.

A front end of the resilient part 710 is fixed to the frame mounting part 700, and a side end of the resilient part 710 may be spaced apart from a side surface of the frame mounting part 700. For example, a slit 712 may be formed between the side end of the resilient part 710 and the side surface of the frame mounting part 700. Thus, the resilient part 710 may be resiliently deformed with respect to the fixed front end.

The resilient part 710 is fixed to the frame mounting part 700 and may include an inclined part 713 that has a slope corresponding to an inclined surface 714, an extension 714 that extends from the inclined part 713 to be in contact with the lower surface of the side surface 141, and an entrance 715 that is inclinedly formed at an end of the extension 714 to gradually widen an entrance of the guide groove 711.

The first fixing protrusion 703 of the frame mounting part 700 may be located above the resilient part 710, more particularly, above the extension 714. In some implementations, in a state in which the door basket 240 is mounted, a side surface 141 in front of a corresponding first fixing groove 145 may be fixed into a space that is defined by the first fixing protrusion 703 and the resilient part 710. In some implementations, the second fixing protrusion 704 may be fixed into a corresponding second fixing groove 146.

Figure 16:
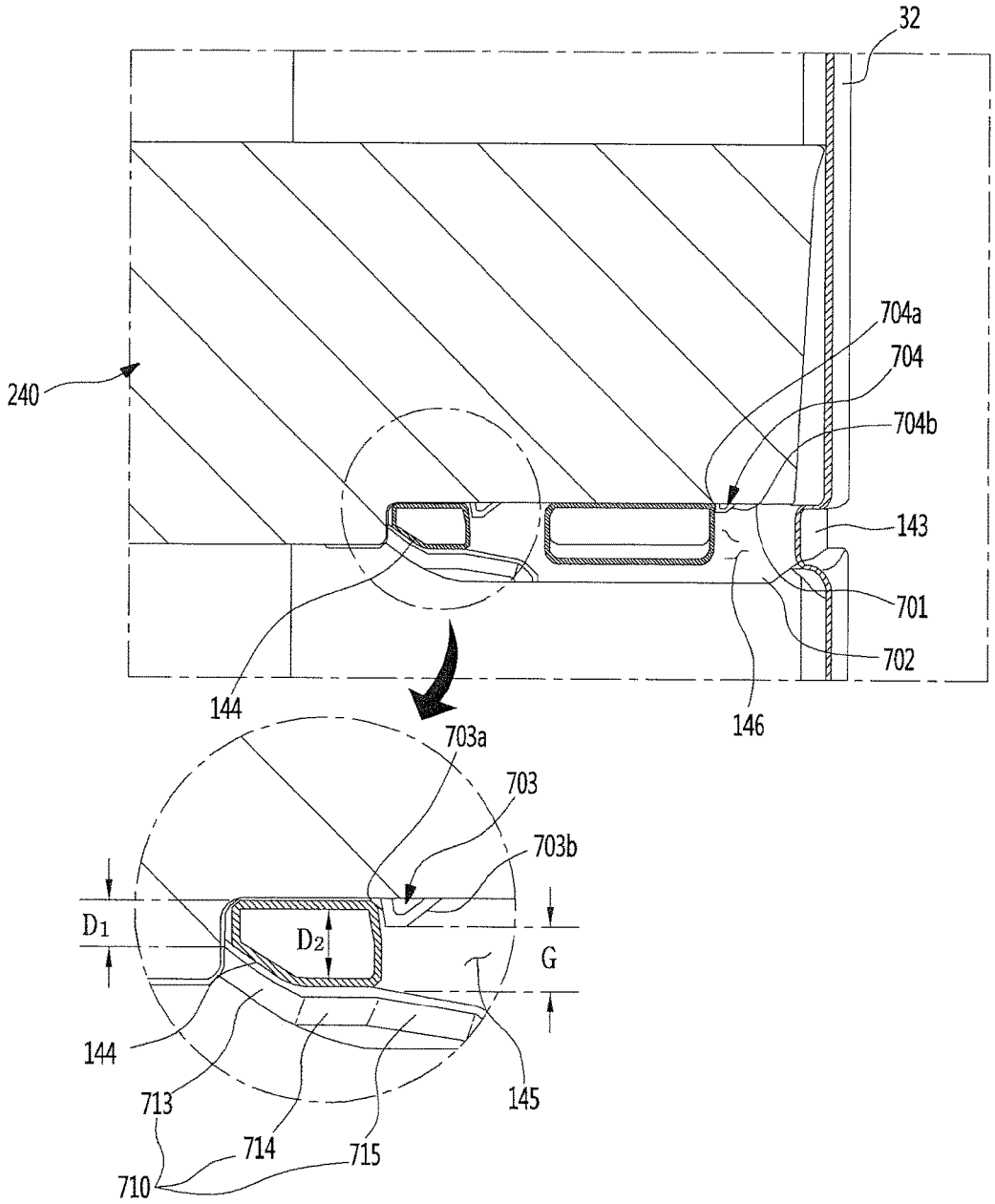
FIGS. 16 and 17 are sectional views of an example door basket mounted to the door.
Figure 17:
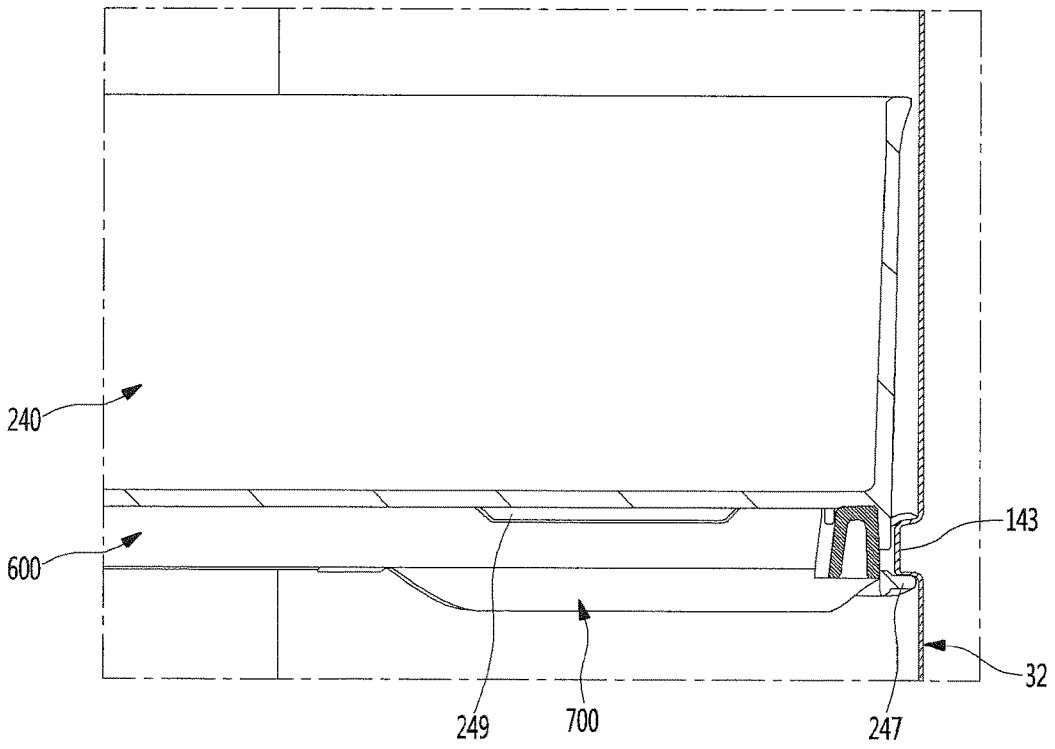

FIGS. 16 and 17 illustrate states in which example door baskets are mounted to doors. In detail, FIG. 16 illustrates an example sectional surface of an inside of an edge, and FIG. 17 illustrates an example sectional surface of an outside of an edge.

Referring to the drawings, a coupling structure of the door mounting part 140 and the frame mounting part 700 in a state in which the door basket 240 is mounted on the door 30 will be described.

In a state in which the door basket 240 is mounted on the door 30, each side surface 141 may be located inside a corresponding frame mounting part 700 and may be completely covered by the side surface 702 of the frame mounting part 700, as illustrated in FIG. 16.

In some implementations, the rear surface 143 may be supported while being in contact with the support rib 247, as illustrated in FIG. 17. For example, opposite surface and a lower end of the rear surface of the door basket 240 may be fixed to the rear surface of the door 30, and thus, a weight that is applied to the door basket 240 may be stably supported.

Here, the side surface 141 may extend in a front-rear direction to effectively support a vertically applied weight.

In some implementations, the rear surface 143 may be restrained by the support rib 247 to support a moment that is applied to the door basket 240, and thus, the door basket 240 having a large capacity may be stably mounted and used.

The first fixing protrusion 703 in the frame mounting part 700 may be located vertically above the resilient part 710. In some implementations, the side surface 141 in front of the first fixing groove 145 may be accommodated in an inner space of the first fixing protrusion 703 and the guide groove 711.

Here, an inclined surface 144 and a lower surface of the side surface 141 is in close contact with the resilient part 710 and an upper surface of the side surface 141 is in contact with the upper surface 701 of the frame mounting part 700. In some implementations, because a front end of each first fixing groove 145 may be restrained by a corresponding first fixing protrusion 703, the side surface 141 in front of the first fixing groove 145 may be entirely fixed into the guide groove 711 in a completely press-fitted form.

An interval G between a lower surface of the first fixing protrusion 703 and the resilient part 710 may be formed larger than a thickness D1 of a front end of the side surface 141. Thus, when the side surface 141 is inserted into the guide groove 711, the front end of the side surface 141 may be smoothly inserted into between the first fixing protrusion 703 and the resilient part 710.

In some implementations, the interval G between the lower end of the first fixing protrusion 703 and an upper end of the resilient part 710 may be formed smaller than a thickness D2 of the side surface 141 at a rear end of the inclined surface 144. Thus, while the side surface 141 is inserted into the guide groove 711, the resilient part 710 is moved along the inclined surface 144, and at this time, while the resilient part 710 is resiliently deformed, the interval G between the first fixing protrusion 703 and the resilient part 710 gradually becomes larger.

When the side surface 141 is completely inserted, the first fixing protrusion 703 is located inside the first fixing groove 145. Here, the resilient part 710 is restored to an original location, and the front side of the side surface 141 may be fixed into the guide groove 711.

In a state in which the door basket 240 is completely mounted, each second fixing protrusion 704 is further inserted into a corresponding second fixing groove 146, so that the door basket 240 may be supported more stably.

Hereinafter, a process of mounting the door basket having the above structure.

Figure 18A:
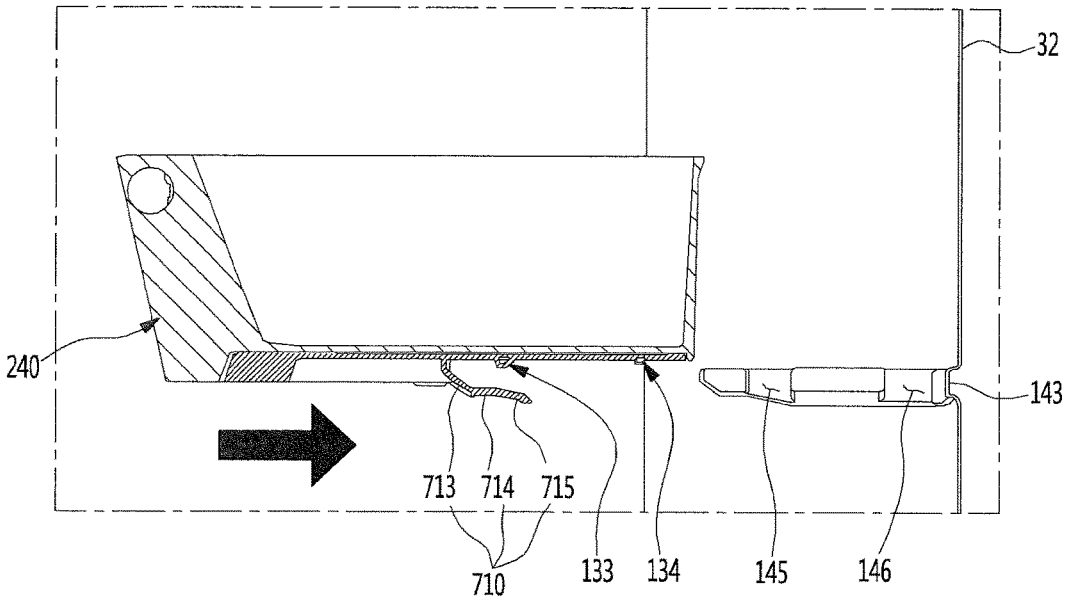
FIGS. 18A to 18C are sequential views of an example process of mounting a basket.
Figure 18B:
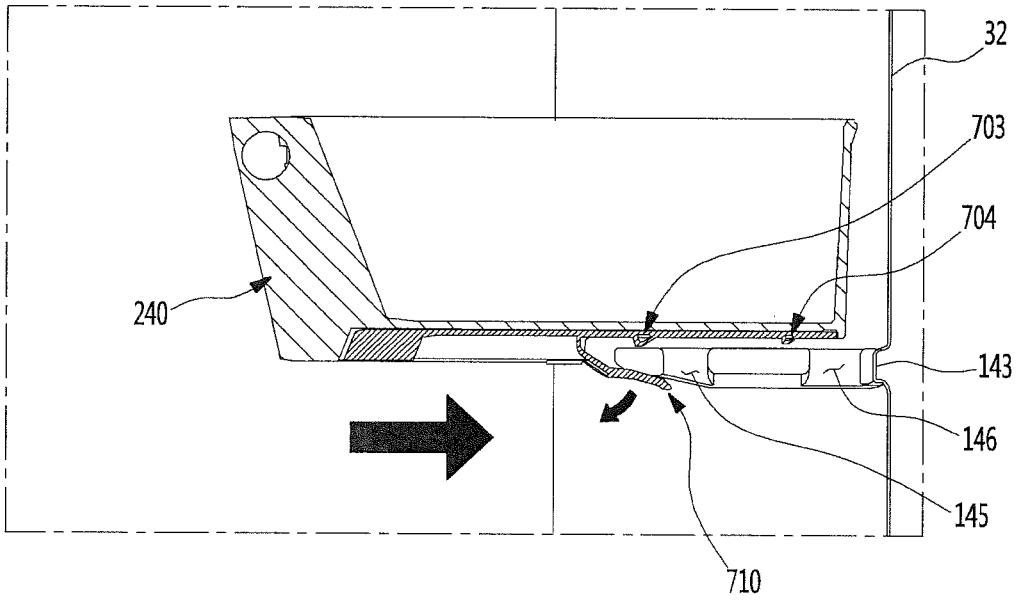
Figure 18C:
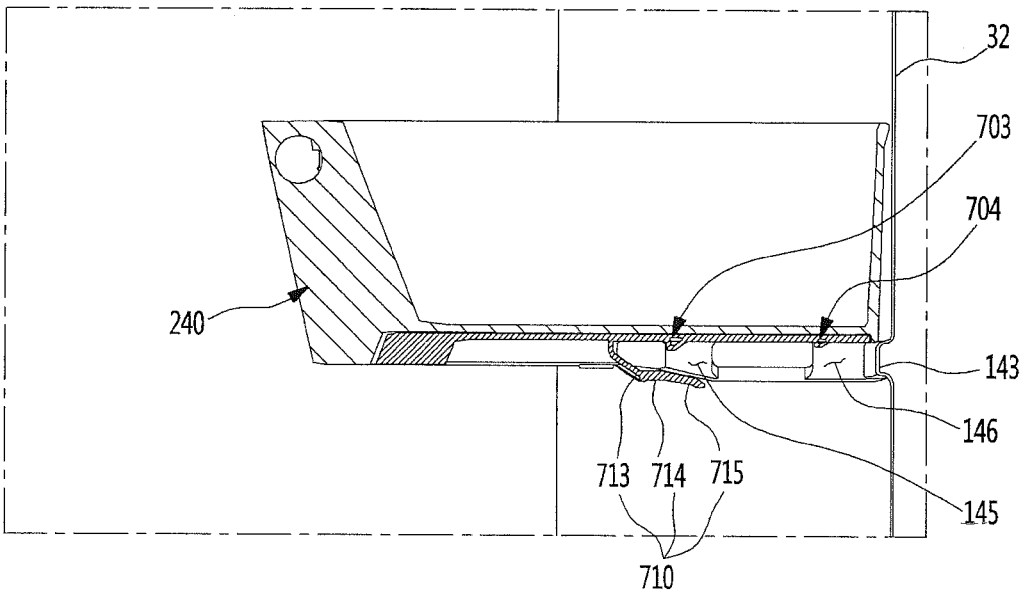

FIGS. 18A to 18C are view sequentially illustrating a process of mounting the basket.

As illustrated in the drawing, to mount the door basket 240, the door basket 240 should be moved at a height corresponding to the location of the door mounting part 140, as illustrated in FIG. 18A.

In this state, in a state in which an external force is not applied to the resilient part 710, the interval G between the first fixing protrusion 703 and the resilient part 710 becomes narrower than the thickness D2 between the rear end of the inclined surface 144 and the side surface 141.

When the door basket 240 is rearward pushed at the height corresponding to the height of the door mounting part 140, the side surfaces 141 may be inserted into entrance areas of guide grooves 711.

Here, the entrance 715 of the resilient part 710 comes into contact with the inclined surface 144 of the side surface 141, and the front end of the side surface 141 is inserted into between the first fixing protrusion 703 and the resilient part 710. In some implementations, in this state, when the door basket 240 is moved further rearward, the inclined surface 144 is moved while being in contact with the extension 714, and while the resilient part 710 is resiliently deformed rearward, the interval G between the first fixing protrusion 703 and the resilient part 710 gradually becomes wider, so that a state as in FIG. 18B is achieved.

In some implementations, when the door basket 240 is completely pushed to the rear surface of the door 30, the front end of the side surface 141 is completely inserted into the guide groove 711, so that a state as in FIG. 18C is achieved.

In this state, the side surface 141 is completely in close contact with the guide groove 711. For example, the inclined surface 144 comes into close contact with the inclined part 713, the lower surface of the side surface 141 comes into close contact with the extension 714, and the upper surface of the side surface 141 comes into contact with the upper surface 701 of the frame mounting part 700. In some implementations, the first fixing protrusion 703 comes into close contact with a front surface of the first fixing groove 145 while being inserted into the first fixing groove 145. Here, the resilient part 710 is restored to an original location, and thus, the interval G between the first fixing protrusion 703 and the resilient part 710 becomes smaller than the thickness D2 of the side surface 141 corresponding to the rear end of the inclined surface 144.

In a state in which the door basket 240 is completely mounted, the door basket 240 is not separated forward by restraint of the first fixing protrusion 730 and the second fixing protrusion 704, and thus, a stable mounting state may be maintained even when there is a rapid rotation manipulation of the door 30.

In a state as in FIG. 18C, the support rib 247 at a rear end of the door basket 240 comes into contact with a lower surface of the rear surface 143. Thus, the rear end of the door basket 240 is caught and restrained, a stable mounting state is maintained without moving even when a moment is generated.

When the location of the door basket 240 is changed or the door basket 240 is separated, the resilient part 710 is elastically deformed, the first fixing protrusion 703 and the second fixing protrusion 704 is pulled by a force at which they may be separated from the first fixing groove 145 and the second fixing groove 146, so that the door basket 240 may be separated.

What is claimed is:

1. A refrigerator comprising:

a cabinet that defines a storage space;

a door that is mounted to the cabinet, that is configured to open and close the storage space, and that comprises (i) a main door that is configured to open and close the cabinet by rotating and that defines an opening to the storage space and (ii) a sub-door that is rotatably mounted to the main door and that is configured to open and close the opening to the storage space;

a mounting part that is located on an inner surface of the door, that defines an inner surface of the opening to the storage space, and that includes first sub-mounting parts that protrude toward the opening, that comprise metal, that are located on an inside of the mounting part, and that each comprise (i) an extension that protrudes from a side surface of the mounting part towards the opening and (ii) a bent part that is bent upward and that is at an end of the extension; and a first basket that is detachably mounted to the mounting part, that is spaced apart from a rear surface of the sub-door, and that comprises:

a basket body that defines an accommodation space that is configured to receive food and that includes a recessed part on a bottom surface of the basket body; and a fixing frame that is located in the recessed part, that is configured to support the basket body, that is detachably mounted to the mounting part, that comprises metal, and that includes fixing mounting parts that are each at locations that correspond to the first sub mounting parts, that are each recessed in a lower surface of the fixing frame towards a top of the first basket, and that are each configured to receive a corresponding first sub-mounting part.

2. The refrigerator of claim 1, wherein the basket body comprises a transparent material such that the accommodation space is visible from outside the basket, and wherein the fixing frame comprises an opaque material such that the corresponding first sub-mounting part is not visible.

3. The refrigerator of claim 1, comprising:

an additional door, an additional mounting part, and an additional basket, wherein side surfaces of the additional mounting part are each located on a corresponding inner surface of a door dike that protrudes from edges of the additional door, and wherein the additional mounting part comprises a rear surface that is configured to connect the side surfaces.

4. The refrigerator of claim 3, wherein the additional basket includes a support rib that protrudes from a rear surface of the additional basket and that is configured to engage the rear surface of the additional mounting part.

5. The refrigerator of claim 1, comprising:

an additional door, an additional mounting, and an additional basket, wherein the additional mounting part is located in door dikes that protrude from left and right edges of the door, and wherein the additional mounting part extends in a direction parallel to a bottom surface of the additional basket.

6. The refrigerator of claim 5, wherein a side surface of an additional frame of the additional basket is configured to cover the additional mounting part by extending downward from a location corresponding to a location of the additional mounting part.

7. The refrigerator of claim 5, wherein the additional mounting part includes inclined surfaces that increase in thickness towards the rear surface of the additional mounting part and that are located at front ends of the additional mounting part, and wherein each inclined surface defines fixing grooves that are recessed in the inclined surface and that are located between the inclined surface and the rear surface of the additional mounting part.

8. The refrigerator of claim 1, wherein the first basket comprises:

fixing members that are each rotatably mounted, at an end of a corresponding fixing member, to the lower surface of the fixing frame, wherein each fixing member is configured to restrain the corresponding first sub-mounting part by rotating based on the corresponding first sub-mounting part being inserted into the corresponding fixing mounting part.

9. The refrigerator of claim 1, wherein the mounting part includes third sub-mounting parts that protrude from lower ends of the mounting part, and wherein the refrigerator comprises a third basket that includes a seating frame that includes seating mounting parts that are recessed in a lower surface of the seating frame and that are each configured to receive a corresponding third sub-mounting part.

10. The refrigerator of claim 9, wherein each seating mounting part includes a seating frame protrusion that protrudes downward and that is located inside the seating mounting part, and wherein each third sub-mounting part includes a protrusion inserting part that is configured to receive a corresponding seating mounting part.

11. The refrigerator of claim 10, wherein each seating frame protrusion and each protrusion are angled towards a lower front portion of the refrigerator.

12. The refrigerator of claim 11, wherein the third basket includes an additional basket body that includes a catching part that protrudes forward and that is located at a front lower end of the additional basket body, and wherein a lower surface of the mounting part includes a protrusion step that defines a catching part supporting part that protrudes upward and that is configured to receive the catching part.

13. The refrigerator of claim 12, wherein the opening includes a display unit that is configured to display and control an operation state of the refrigerator, and wherein the display unit is mounted on the protrusion step.

14. The refrigerator of claim 1, wherein an inner surface of the mounting part includes second sub-mounting parts that are recessed inward towards a center of the door, and wherein the refrigerator comprises a second basket that includes a movable frame that is configured to connect to the second sub-mounting parts and that is vertically adjustable with respect to the second sub-mounting parts.

15. A refrigerator comprising:

a cabinet that defines a storage space;

a door that is mounted to the cabinet, that is configured to open and close the storage space, and that comprises (i) a main door that is configured to open and close the cabinet by rotating and that defines an opening to the storage space and (ii) a sub-door that is rotatably mounted to the main door and that is configured to open and close the opening to the storage space;

a mounting part that is located on an inner surface of the door, that defines an inner surface of the opening to the storage space, and that includes first mounting parts that protrude toward the opening, that comprise metal, and that are located on an inside of the mounting part; and baskets that are each detachably mounted to the mounting part, that are each mounted to the mounting part, that are each spaced apart from a rear surface of the sub door, and that each comprise:

a basket body that defines an accommodation space that is configured to receive food and that includes a recessed part on a bottom surface of the basket body; and a frame that is located in the recessed part, that is configured to support the basket body, that is detachably mounted to the mounting part, and that is a fixing frame that comprises metal and that includes fixing mounting parts that are each at locations that correspond to the first mounting parts and that are each configured to receive the first mounting parts.

* * * * *